US012130055B2

(12) United States Patent
Yun et al.

(10) Patent No.: US 12,130,055 B2
(45) Date of Patent: Oct. 29, 2024

(54) REFRIGERATOR CONTROL METHOD

(71) Applicant: LG ELECTRONICS INC., Seoul (KR)

(72) Inventors: Seokjun Yun, Seoul (KR); Hyoungkeun Lim, Seoul (KR); Junghun Lee, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 454 days.

(21) Appl. No.: 17/433,957

(22) PCT Filed: Feb. 13, 2020

(86) PCT No.: PCT/KR2020/002072

§ 371 (c)(1),
(2) Date: Aug. 25, 2021

(87) PCT Pub. No.: WO2020/175826

PCT Pub. Date: Sep. 3, 2020

(65) Prior Publication Data

US 2022/0146154 A1 May 12, 2022

(30) Foreign Application Priority Data

Feb. 28, 2019 (KR) ..... 10-2019-0024225

(51) Int. Cl.

| | |
|---|---|
| ***F25B 21/02*** | (2006.01) |
| ***F25B 5/02*** | (2006.01) |
| ***F25B 5/04*** | (2006.01) |
| ***F25B 25/00*** | (2006.01) |
| ***F25B 41/20*** | (2021.01) |
| ***F25D 11/02*** | (2006.01) |

(Continued)

(52) U.S. Cl.

CPC ..... *F25B 21/02* (2013.01); *F25B 5/02* (2013.01); *F25B 5/04* (2013.01); *F25B 25/00* (2013.01);

(Continued)

(58) Field of Classification Search

CPC ..... F25B 21/02; F25B 21/04; F25B 25/00; F25B 2600/2511; F25B 2600/02;

(Continued)

(56) References Cited

U.S. PATENT DOCUMENTS 5,678,416 A 10/1997 Yoo et al.
2012/0047911 A1 3/2012 Bhavsar et al.

(Continued)

FOREIGN PATENT DOCUMENTS

CN 1135595 A 11/1996
CN 1291277 A 4/2001

(Continued)

OTHER PUBLICATIONS

WO-2019058450-A1 English Translation (Year: 2019).*

*Primary Examiner* — David J Teitelbaum
*Assistant Examiner* — Devon Moore
(74) *Attorney, Agent, or Firm* — Bryan Cave Leighton Paisner LLP

(57) ABSTRACT

In a refrigerator control method according to an embodiment of the present invention, an operation corresponding to a freezer chamber load is performed when a heat load penetrates the inside of the freezer chamber, and the internal temperature of a deep-freezing chamber is differently set and controlled according to the on/off state of a deep-freezing chamber mode, and thus the input condition of the operation corresponding to the freezer chamber load can be differently set according to the on/off state of the deep-freezing chamber mode.

14 Claims, 10 Drawing Sheets

(51) Int. Cl.
*F25D 17/06* (2006.01)
*F25D 29/00* (2006.01)

(52) U.S. Cl.
CPC ..... *F25B 41/20* (2021.01); *F25D 11/022* (2013.01); *F25D 11/025* (2013.01); *F25D 17/065* (2013.01); *F25D 29/00* (2013.01); *F25B 2600/2507* (2013.01); *F25B 2600/2511* (2013.01); *F25D 2317/04111* (2013.01); *F25D 2317/061* (2013.01); *F25D 2600/02* (2013.01); *F25D 2600/06* (2013.01); *F25D 2700/121* (2013.01); *F25D 2700/122* (2013.01)

(58) Field of Classification Search
CPC ..... F25B 2321/02; F25B 2321/023; F25B 2321/025; F25B 5/02; F25D 11/022; F25D 11/04; F25D 11/025; F25D 11/02; F25D 2317/04111; F25D 2317/061; F25D 2700/122; F25D 2700/06; F25D 2700/14; F25D 17/06; F25D 17/062; F25D 17/065
See application file for complete search history.

(56) References Cited

U.S. PATENT DOCUMENTS

| | | | | |
|---|---|---|---|---|
| 2014/0290303 | A1* | 10/2014 | Shin | F25D 17/065 62/419 |
| 2015/0121925 | A1* | 5/2015 | Park | F25D 17/065 62/186 |
| 2018/0031297 | A1 | 2/2018 | Kim et al. | |
| 2018/0066883 | A1 | 3/2018 | Oh et al. | |
| 2019/0011158 | A1 | 1/2019 | Sul et al. | |

FOREIGN PATENT DOCUMENTS

| | | | | |
|---|---|---|---|---|
| CN | 108626933 | A | 10/2018 | |
| CN | 113474608 | A | 10/2021 | |
| CN | 113544451 | A | 10/2021 | |
| EP | 2787308 | A2 * | 10/2014 | F25D 11/022 |
| JP | 2004278890 | A | 10/2004 | |
| JP | 2017146080 | A | 8/2017 | |
| KR | 960018462 | A | 6/1996 | |
| KR | 10-0191499 | B1 | 6/1999 | |
| KR | 10-0597304 | B1 | 12/2006 | |
| KR | 20100086705 | A | 8/2010 | |
| KR | 10-2016-0097648 | A | 8/2016 | |
| KR | 20170133840 | A | 12/2017 | |
| KR | 10-1821289 | B1 | 1/2018 | |
| KR | 101821290 | B1 | 1/2018 | |
| KR | 20180049670 | A | 5/2018 | |
| KR | 10-2018-0105572 | A | 9/2018 | |
| KR | 10-2019-0005042 | A | 1/2019 | |
| WO | WO-2014097230 | A1 * | 6/2014 | F25D 11/02 |
| WO | WO-2019058450 | A1 * | 3/2019 | F25B 1/00 |

* cited by examiner (a)

(b)

(c)

REFRIGERATOR CONTROL METHOD

This application is the National Stage filing under 35 U.S.C. 371 of International Application No. PCT/KR2020/002072, filed on Feb. 13, 2020 which claims the benefit of Korean Patent Application No. 10-2019-0024225, filed on Feb. 28, 2019, the contents of which are all hereby incorporated by reference herein in their entirety.

TECHNICAL FIELD

The present invention relates to a method for controlling a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, if a temperature condition for the storage compartment is set to a cryogenic state that is significantly lower than the current temperature of the freezing temperature. Thus, when the food quickly passes through a freezing point temperature range while the food is changed in the frozen state, the destruction of the cells may be minimized, and as a result, even after the unfreezing, the meat quality and the taste of the food may return to close to the state before the freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

Korean Patent Publication No. 2018-0105572 (Sep. 28, 2018) (Prior Art 1) discloses a refrigerator having the form of a bedside table, in which a storage compartment has a temperature lower than the room temperature by using a thermoelectric module.

However, in the case of the refrigerator using the thermoelectric module disclosed in Prior Art 1, since a heat generation surface of the thermoelectric module is configured to be cooled by heat-exchanged with indoor air, there is a limitation in lowering a temperature of the heat absorption surface.

In detail, in the thermoelectric module, when supply current increases, a temperature difference between the heat absorption surface and the heat generation surface tends to increase to a certain level. However, due to characteristics of the thermoelectric element made of a semiconductor element, when the supply current increases, the semiconductor acts as resistance to increase in self-heat amount. Then, there is a problem that heat absorbed from the heat absorption surface is not transferred to the heat generation surface quickly.

In addition, if the heat generation surface of the thermoelectric element is not sufficiently cooled, a phenomenon in which the heat transferred to the heat generation surface flows back toward the heat absorption surface occurs, and a temperature of the heat absorption surface also rises.

In the case of the thermoelectric module disclosed in Prior Art 1, since the heat generation surface is cooled by the indoor air, there is a limit that the temperature of the heat generation surface is not lower than an room temperature.

In a state in which the temperature of the heat generation surface is substantially fixed, the supply current has to increase to lower the temperature of the heat absorption surface, and then efficiency of the thermoelectric module is deteriorated.

In addition, if the supply current increases, a temperature difference between the heat absorption surface and the heat generation surface increases, resulting in a decrease in the cooling capacity of the thermoelectric module.

Therefore, in the case of the refrigerator disclosed in Prior Art 1, it is impossible to lower the temperature of the storage compartment to a cryogenic temperature that is significantly lower than the temperature of the freezing compartment and may be said that it is only possible to maintain the temperature of the refrigerating compartment.

In order to overcome limitations of the thermoelectric module and to lower the temperature of the storage compartment to a temperature lower than that of the freezing compartment by using the thermoelectric module, many experiments and studies have been conducted. As a result, in order to cool the heat generation surface of the thermoelectric module to a low temperature, an attempt has been made to attach an evaporator through which a refrigerant flows to the heat generation surface.

Korean Patent Publication No. 10-2016-097648 (Aug. 18, 2016) (Prior Art 2) discloses directly attaching a heat generation surface of a thermoelectric module to an evaporator to cool the heat generation surface of the thermoelectric module.

However, Prior Art 2 still has problems.

In Prior Art 2, an operation control method between an evaporator for cooling the heat generation surface of the thermoelectric module and the freezing compartment evaporator is not described at all. In detail, since a so-called deep freezing compartment cooled by the thermoelectric module is accommodated in the freezing compartment, when a load is applied to either or both of the freezing compartment and the deep freezing compartment, the contents of the control method of the refrigerant circulation system with respect to which storage compartment is prioritized for the load correspondence operation has not been disclosed at all.

In Prior Art 2, when a load is applied to the refrigerating compartment other than the freezing compartment, the contents of how to perform the load correspondence operation are not described at all. This means that only the structure using the evaporator as a cooling means for the heat generation surface of the thermoelectric element has been studied, and when it is actually applied to a refrigerator, it means that research has not been done on problems arising from load input, and the control method to eliminate these problems.

For example, when a load is put into the freezing compartment, moisture is generated inside the freezing compartment, and if the moisture is not removed quickly, the moisture is attached to an outer wall of the deep freezing compartment to cause a problem of forming frost.

Particularly, when the load is simultaneously applied to the refrigerating compartment and the freezing compartment, the refrigerating compartment load correspondence operation is preferentially performed, and the freezing compartment load correspondence operation is not performed. That is, during the refrigerating compartment load correspondence operation, even when the load is applied to the freezing compartment, a freezing compartment fan is not driven, and thus, it is difficult to prevent a problem in that moisture generated inside the freezing compartment is attached to be grown on the outer wall of the deep freezing compartment.

In addition, when the indoor space in which the refrigerating compartment is installed is in a low temperature region such as in winter, an operation rate of the freezing compartment fan is low, and thus, the moisture generated inside the freezing compartment is removed quickly, resulting in a problem that frost is generated on the outer wall of the deep freezing compartment.

A more serious problem is that, when the frost is formed on the outer wall of the deep freezing compartment, there is no suitable method other than a method of physically removing the frost by the user or stopping the operation of the freezing compartment and waiting until the temperature of the freezing compartment increases to a temperature that melts the frost.

If the user removes the frost attached to the outer wall of the deep freezing compartment using a tool, a problem in which the outer wall of the deep freezing compartment is damaged may occur.

If the method of defrosting the frost by stopping the operation of the freezing compartment is selected, there may be a problem in that, if food stored in the freezing compartment does not move to another place, the food is spoiled.

Although the refrigerator having a structure in which the deep greenhouse is accommodated in the freezing compartment has such a serious problem, in Prior Art 2, there is no mention of such a predictable problem, and there is no mention of a method for responding to the problem.

DISCLOSURE OF THE INVENTION

Technical Problem

The present invention is proposed to solve the expected problems presented above.

Particularly, an object of the prevent invention is to provide a control method, when a situation in which a load is put into a refrigerating compartment and a freezing compartment for each case in which a deep freezing compartment mode is in an on state and an off state, a temperature of each storage compartment is quickly lowered to a satisfactory temperature range.

Particularly, an object of the present invention is to provide a method for controlling a refrigerator, which is capable of preventing a problem of frost generated on an outer wall of a deep freezing compartment when a load is applied to the inside of the freezing compartment.

In addition, since possibility that frost is generated on an outer wall of a deep freezing compartment is different depending on a room temperature, a control method for preventing the occurrence of frost is designed differently depending on a room temperature to solve the problem of generation of frost regardless of the room temperature.

Technical Solution

In a method for controlling a refrigerator according to an embodiment of the present invention for achieving the above objects, when a heat load is penetrated into the freezing compartment, a freezing compartment load correspondence operation is performed, an input condition for a freezing compartment load correspondence operation may be differently set according to whether a deep freezing compartment mode is in an on state because an internal temperature of a deep freezing compartment is differently set and controlled according to a state in which a deep freezing compartment mode is in on/off state.

Particularly, when the deep freezing compartment mode is in the on state, an input condition for a first freezing compartment load correspondence operation may be applied, when the deep freezing compartment mode is in an off state, an input condition for a second freezing compartment load correspondence operation may be applied, and a minimum value of a heat load, which satisfies the input condition for the first freezing compartment load correspondence operation may be set to be less than a minimum value of a heat load, which satisfies the input condition for the second freezing compartment load correspondence operation.

In addition, when the input condition for the freezing compartment load correspondence operation is satisfied, whether a room temperature condition is satisfied may be determined, and the room temperature condition may be differently applied according to the on/off state of the deep freezing compartment mode.

Here, when the deep freezing compartment mode is turned on, a room temperature zone (RT zone) enabling the freezing compartment load correspondence operation to be inputted may be defined as a first room temperature region, and when the deep freezing compartment mode is turned off, the room temperature zone (RT zone) enabling the freezing compartment load correspondence operation to be inputted may be defined as a second room temperature region.

The first room temperature region may be set to be wider than the second room temperature region.

A minimum room temperature belonging to the first room temperature region may be set to be lower than a minimum room temperature belonging to the second room temperature region.

When it is determined that the room temperature zone (RT zone) enabling a current room temperature belongs is the room temperature region in which the freezing compartment load correspondence operation to be inputted, the controller may determine first whether the input condition for the refrigerating compartment load correspondence operation conflicts.

When it is determined that the input condition for the refrigerating compartment load correspondence operation conflicts, the freezing compartment load correspondence operation may be stopped, and the refrigerating compartment load correspondence operation may be performed by priority.

When the refrigerating compartment load correspondence operation is performed in preference to the freezing compartment load correspondence operation, the freezing compartment fan may be controlled to be driven at a low speed.

When the refrigerating compartment temperature enters a satisfactory temperature region, the refrigerating compartment load correspondence operation may be ended, and the freezing compartment load correspondence operation may be released to stop the driving of the freezing compartment fan.

When the freezing compartment load correspondence operation is released in the state in which the deep freezing compartment mode is in the on state, the process may return to the determining of whether the input condition for the first freezing compartment load correspondence operation is satisfied, and when the freezing compartment load correspondence operation is released in the state in which the deep freezing compartment mode is in the off state, the process may return to the determining of whether the input condition for the second freezing compartment load correspondence operation is satisfied.

When the deep freezing compartment mode is in the on state, and the refrigerating compartment temperature enters a satisfactory temperature region, the refrigerating compartment load correspondence operation may be ended, and while the low-speed driving of the freezing compartment fan is maintained, the controller redetermines whether the input condition for the first freezing compartment load correspondence operation may be satisfied.

Alternatively, when the deep freezing compartment mode is in the on state, and the refrigerating compartment temperature enters a satisfactory temperature region, the refrigerating compartment load correspondence operation may be ended, and the freezing compartment load correspondence operation may be pursued.

When it is determined that the input condition for the refrigerating compartment load correspondence operation is not satisfied, the freezing compartment load correspondence operation may be performed, and when a set time elapses after the freezing compartment temperature enters a satisfactory temperature region, or the freezing compartment load correspondence operation starts, the freezing compartment load correspondence operation may be released.

In addition, when the refrigerating compartment temperature enters an upper limit region while the freezing compartment load correspondence operation is performed, the mode may be switched to a simultaneous operation mode in which the refrigerating compartment and the freezing compartment are cooled at the same time.

When at least one of the refrigerating compartment temperature or the freezing compartment temperature enters the satisfactory temperature region while the simultaneous operation mode is performed, the freezing compartment load correspondence operation may be released.

Advantageous Effects

According to the method for controlling the refrigerator according to the embodiment of the present invention, which has the configuration as described above, the following effects are obtained.

First, according to the control method of the present invention, when it is detected that a load is input into the freezing compartment in which the deep freezing compartment is accommodated, the freezing compartment load correspondence operation may be immediately performed to discharge the moisture generated in the freezing compartment to the freezing evaporation compartment in which the freezing compartment evaporator is accommodated.

As a result, the moisture transferred into the freezing compartment evaporator may be attached to the surface of the freezing compartment evaporator and condensed into water through the defrosting of the freezing compartment evaporator and then discharged to the outside of the refrigerator.

Thus, there may be no need for the user to remove the frost formed on the outer wall of the deep freezing compartment by using the tool or hand, and also, there may be no need to increase in temperature of the freezing compartment so as to remove the frost.

In addition, when the increase in load in the refrigerating compartment and the increase in load of the freezing compartment occur at the same time or with a time difference, i.e., when the load correspondence operations conflict with each other, the load correspondence operations may be prioritized and appropriately controlled to minimize the phenomenon in which the frost is generated on the outer wall of the deep freezing compartment or the inner wall of the freezing compartment.

In addition, there may be the advantage in that the load correspondence operation for each room temperature is appropriately performed in consideration of the characteristics of the deep freezing compartment sensitive to the room temperature to minimize the phenomenon in which the frost is generated on the outer wall of the deep freezing compartment or the inner wall of the freezing compartment.

MODE FOR CARRYING OUT THE INVENTION

Figure 1:
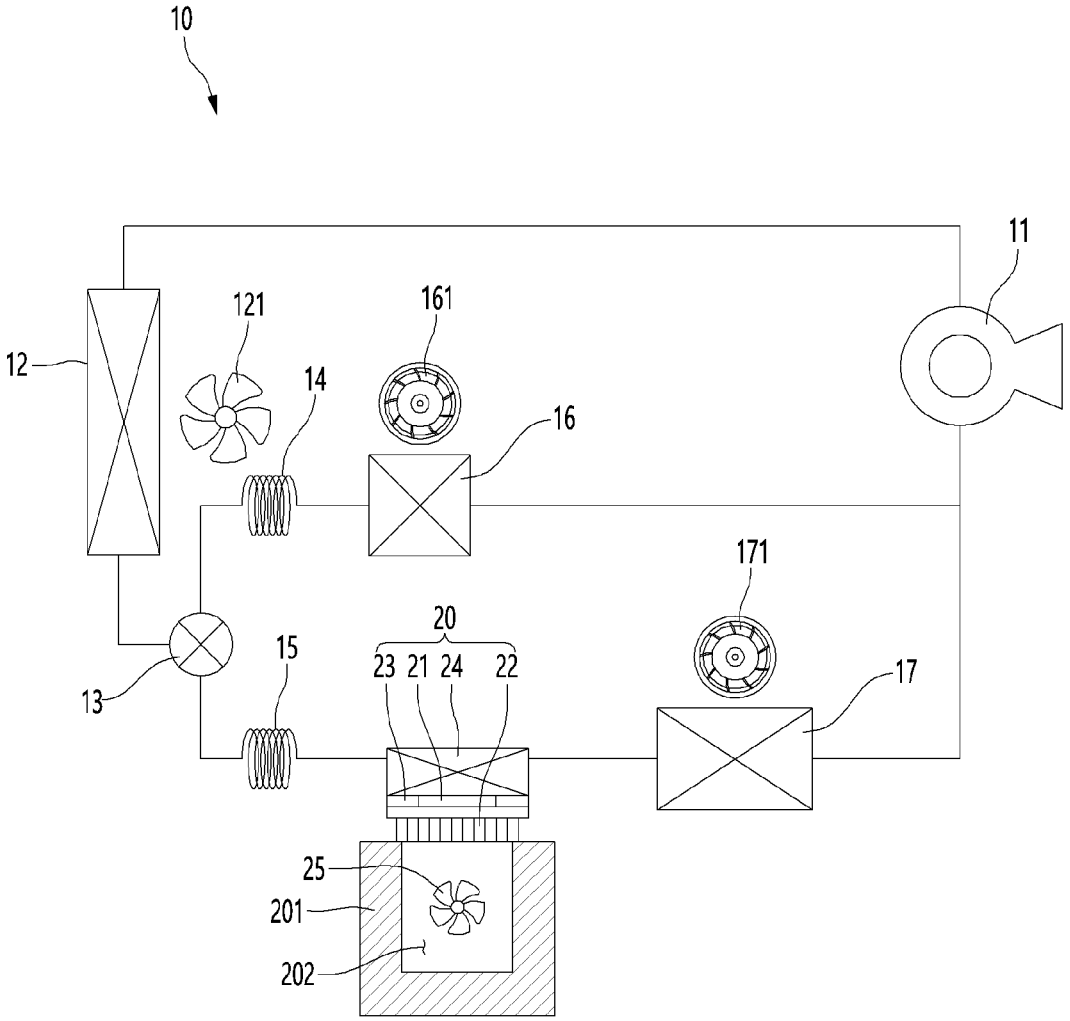
FIG. 1 is a view illustrating a refrigerant circulation system of a refrigerator to which a control method is applied according to an embodiment of the present invention.

Hereinafter, a method for controlling a refrigerator according to an embodiment of the present invention will be described in detail with reference to the accompanying drawings.

In the present invention, a storage compartment that is cooled by a first cooling device and controlled to a predetermined temperature may be defined as a first storage compartment.

In addition, a storage compartment that is cooled by a second cooling device and is controlled to a temperature lower than that of the first storage compartment may be defined as a second storage compartment.

In addition, a storage compartment that is cooled by the third cooling device and is controlled to a temperature lower than that of the second storage compartment may be defined as a third storage compartment.

The first cooling device for cooling the first storage compartment may include at least one of a first evaporator or a first thermoelectric module including a thermoelectric element. The first evaporator may include a refrigerating compartment evaporator to be described later.

The second cooling device for cooling the second storage compartment may include at least one of a second evaporator or a second thermoelectric module including a thermoelectric element. The second evaporator may include a freezing compartment evaporator to be described later.

The third cooling device for cooling the third storage compartment may include at least one of a third evaporator or a third thermoelectric module including a thermoelectric element.

In the embodiments in which the thermoelectric module is used as a cooling means in the present specification, it may be applied by replacing the thermoelectric module with an evaporator, for example, as follows.

(1) "Cold sink of thermoelectric module", "heat absorption surface of thermoelectric module" or "heat absorption side of thermoelectric module" may be interpreted as "evaporator or one side of the evaporator".

(2) "Heat absorption side of thermoelectric module" may be interpreted as the same meaning as "cold sink of thermoelectric module" or "heat absorption side of thermoelectric module".

(3) An electronic controller processor "applies or cuts off a constant voltage to the thermoelectric module" may be interpreted as the same meaning as being controlled to "supply or block a refrigerant to the evaporator", "control a switching valve to be opened or closed", or "control a compressor to be turned on or off".

(4) "Controlling the constant voltage applied to the thermoelectric module to increase or decrease" by the controller may be interpreted as the same meaning as "controlling an amount or flow rate of the refrigerant flowing in the evaporator to increase or decrease", "controlling allowing an opening degree of the switching valve to increase or decrease", or "controlling an output of the compressor to increase or decrease".

(5) "Controlling a reverse voltage applied to the thermoelectric module to increase or decrease" by the controller is interpreted as the same meaning as "controlling a voltage applied to the defrost heater adjacent to the evaporator to increase or decrease".

In the present specification, "storage compartment cooled by the thermoelectric module" is defined as a storage compartment A, and "fan located adjacent to the thermoelectric module so that air inside the storage compartment A is heat-exchanged with the heat absorption surface of the thermoelectric module" may be defined as "storage compartment fan A".

Also, a storage compartment cooled by the cooling device while constituting the refrigerator together with the storage compartment A may be defined as "storage compartment B".

In addition, a "cooling device chamber" may be defined as a space in which the cooling device is disposed, in a structure in which the fan for blowing cool air generated by the cooling device is added, the cooling device chamber may be defined as including a space in which the fan is accommodated, and in a structure in which a passage for guiding the cold air blown by the fan to the storage compartment or a passage through which defrost water is discharged is added may be defined as including the passages.

In addition, a defrost heater disposed at one side of the cold sink to remove frost or ice generated on or around the cold sink may be defined as a cold sink defrost heater.

In addition, a defrost heater disposed at one side of the heat sink to remove frost or ice generated on or around the heat sink may be defined as a heat sink defrost heater.

In addition, a defrost heater disposed at one side of the cooling device to remove frost or ice generated on or around the cooling device may be defined as a cooling device defrost heater.

In addition, a defrost heater disposed at one side of a wall surface forming the cooling device chamber to remove frost or ice generated on or around the wall surface forming the cooling device chamber may be defined as a cooling device chamber defrost heater.

In addition, a heater disposed at one side of the cold sink may be defined as a cold sink drain heater in order to minimize refreezing or re-implantation in the process of discharging defrost water or water vapor melted in or around the cold sink.

In addition, a heater disposed at one side of the heat sink may be defined as a heat sink drain heater in order to minimize refreezing or re-implantation in the process of discharging defrost water or water vapor melted in or around the heat sink.

In addition, a heater disposed at one side of the cooling device may be defined as a cooling device drain heater in order to minimize refreezing or re-implantation in the process of discharging defrost water or water vapor melted in or around the cooling device.

In addition, in the process of discharging the defrost water or water vapor melted from or around the wall forming the cooling device chamber, a heater disposed at one side of the wall forming the cooling device chamber may be defined as a cooling device chamber drain heater in order to minimize refreezing or re-implantation.

Also, a "cold sink heater" to be described below may be defined as a heater that performs at least one of a function of the cold sink defrost heater or a function of the cold sink drain heater.

In addition, the "heat sink heater" may be defined as a heater that performs at least one of a function of the heat sink defrost heater or a function of the heat sink drain heater.

In addition, the "cooling device heater" may be defined as a heater that performs at least one of a function of the cooling device defrost heater or a function of the cooling device drain heater.

In addition, a "back heater" to be described below may be defined as a heater that performs at least one of a function of the heat sink heater or a function of the cooling device chamber defrost heater. That is, the back heater may be defined as a heater that performs at least one function among the functions of the heat sink defrost heater, the heater sink drain heater, and the cooling device chamber defrost heater.

In the present invention, as an example, the first storage compartment may include a refrigerating compartment that is capable of being controlled to a zero temperature by the first cooling device.

In addition, the second storage compartment may include a freezing compartment that is capable of being controlled to a temperature below zero by the second cooling device.

In addition, the third storage compartment may include a deep freezing compartment that is capable of being maintained at a cryogenic temperature or an ultrafrezing temperature by the third cooling device.

In the present invention, a case in which all of the third to third storage compartments are controlled to a temperature below zero, a case in which all of the first to third storage compartments are controlled to a zero temperature, and a case in which the first and second storage compartments are controlled to the zero temperature, and the third storage compartment is controlled to the temperature below zero are not excluded.

In the present invention, an "operation" of the refrigerator may be defined as including four processes such as a process (I) of determining whether an operation start condition or an operation input condition is satisfied, a process (II) of performing a predetermined operation when the operation input condition is satisfied, a process (III) of determining whether an operation completion condition is satisfied, and a process (IV) of terminating the operation when the operation completion condition is satisfied.

In the present invention, an "operation" for cooling the storage compartment of the refrigerator may be defined by being divided into a general operation and a special operation.

The general operation may be referred to as a cooling operation performed when an internal temperature of the refrigerator naturally increases in a state in which the storage compartment door is not opened, or a load input condition due to food storage does not occur.

In detail, when the temperature of the storage compartment enters an unsatisfactory temperature region (described below in detail with reference to the drawings), and the operation input condition is satisfied, the controller controls the cold air to be supplied from the cooling device of the storage compartment so as to cool the storage compartment.

Specifically, the general operation may include a refrigerating compartment cooling operation, a freezing compartment cooling operation, a deep freezing compartment cooling operation, and the like.

On the other hand, the special operation may mean an operation other than the operations defined as the general operation.

In detail, the special operation may include a defrost operation controlled to supply heat to the cooling device so as to melt the frost or ice deposited on the cooling device after a defrost period of the storage compartment elapses.

In addition, the special operation may further include a load correspondence operation for controlling the cold air to be supplied from the cooling device to the storage compartment so as to remove a heat load penetrated into the storage compartment when a set time elapses from a time when a door of the storage compartment is opened and closed, or when a temperature of the storage compartment rises to a set temperature before the set time elapses.

In detail, the load correspondence operation includes a door load correspondence operation performed to remove a load penetrated into the storage compartment after opening and closing of the storage compartment door, and an initial cold start operation performed to remove a load correspondence operation performed to remove a load inside the storage compartment when power is first applied after installing the refrigerator.

For example, the defrost operation may include at least one of a refrigerating compartment defrost operation, a freezing compartment defrost operation, and a deep freezing compartment defrost operation.

Also, the door load correspondence operation may include at least one of a refrigerating compartment door load correspondence operation, a freezing compartment door load correspondence operation, and a deep freezing compartment load correspondence operation.

Here, the deep freezing compartment load correspondence operation may be interpreted as an operation for removing the deep freezing compartment load, which is performed when at least one condition for the deep freezing compartment door load correspondence input condition performed when the load increases due to the opening of the door of the deep freezing compartment, the initial cold start operation input condition preformed to remove the load within the deep freezing compartment when the deep freezing compartment is switched from an on state to an off state, or the operation input condition after the defrosting that initially stats after the deep freezing compartment defrost operation is completed.

In detail, determining whether the operation input condition corresponding to the load of the deep freezing compartment door is satisfied may include determining whether at least one of a condition in which a predetermined amount of time elapses from at time point at which at least one of the freezing compartment door and the deep freezing compartment door is closed after being opened, or a condition in which a temperature of the deep freezing compartment rises to a set temperature within a predetermined time is satisfied.

In addition, determining whether the initial cold start operation input condition for the deep freezing compartment is satisfied may include determining whether the refrigerator is powered on, and the deep freezing compartment mode is switched from the off state to the on state.

In addition, determining whether the operation input condition is satisfied after the deep freezing compartment defrost may include determining at least one of stopping of the reverse voltage applied to the thermoelectric module for cold sink heater off, back heater off, cold sink defrost, stopping of the constant voltage applied to the thermoelectric module for the heat sink defrost after the reverse voltage is applied for the cold sink defrost, an increase of a temperature of a housing accommodating the heat sink to a set temperature, or terminating of the freezing compartment defrost operation.

Thus, the operation of the storage compartment including at least one of the refrigerating compartment, the freezing compartment, or the deep freezing compartment may be summarized as including the general storage compartment operation and the storage compartment special operation.

When two operations conflict with each other during the operation of the storage compartment described above, the controller may control one operation (operation A) to be performed preferentially and the other operation (operation B) to be paused.

In the present invention, the conflict of the operations may include i) a case in which an input condition for the operation A and an input condition for the operation B are satisfied at the same time to conflict with each other, a case in which the input condition for the operation B is satisfied while the input condition for the operation A is satisfied to perform the operation A to conflict with each other, and a case in which the input condition for operation A is satisfied while the input condition for the operation B is satisfied to perform the operation B to conflict with each other.

When the two operations conflict with each other, the controller determines the performance priority of the conflicting operations to perform a so-called "conflict control algorithm" to be executed in order to control the performance of the correspondence operation.

A case in which the operation A is performed first, and the operation B is stopped will be described as an example.

In detail, in the present invention, the paused operation B may be controlled to follow at least one of the three cases of the following example after the completion of the operation A.

a. Termination of Operation B

When the operation A is completed, the performance of the operation B may be released to terminate the conflict control algorithm and return to the previous operation process.

Here, the "release" does not determine whether the paused operation B is not performed any more, and whether the input condition for the operation B is satisfied. That is, it is seen that the determination information on the input condition for the operation B is initialized.

b. Redetermination of Input Condition of Operation B

When the firstly performed operation A is completed, the controller may return to the process of determining again whether the input condition for the paused operation B is satisfied, and determine whether the operation B restarts.

For example, if the operation B is an operation in which the fan is driven for 10 minutes, and the operation is stopped when 3 minutes elapses after the start of the operation due to the conflict with the operation A, it is determined again whether the input condition for the operation B is satisfied at a time point at which the operation A is completed, and if it is determined to be satisfied, the fan is driven again for 10 minutes.

c. Continuation of Operation B

When the firstly performed operation A is completed, the controller may allow the paused operation B to be continued. Here, "continuation" means not to start over from the beginning, but to continue the paused operation.

For example, if the operation B is an operation in which the fan is driven for 10 minutes, and the operation is paused after 3 minutes elapses after the start of the operation due to the conflict with operation A, the compressor is further driven for the remaining time of 7 minutes immediately after the operation A is completed.

In the present invention, the priority of the operations may be determined as follows.

First, when the general operation and the special operation conflict with each other, it is possible to control the special operation to be performed preferentially.

Second, when the conflict between the general operations occurs, the priority of the operations may be determined as follows.

I. When the refrigerating compartment cooling operation and the freezing compartment cooling operation conflict with each other, the refrigerating compartment cooling operation may be performed preferentially.

II. When the refrigerating compartment (or freezing compartment) cooling operation and the deep freezing compartment cooling operation conflict with each other, the refrigerating compartment (or freezing compartment) cooling operation may be performed preferentially. Here, in order to prevent the deep freezing compartment temperature from rising excessively, cooling capacity having a level lower than that of maximum cooling capacity of the deep freezing compartment cooling device may be supplied from the deep freezing compartment cooling device to the deep freezing compartment.

The cooling capacity may mean at least one of cooling capacity of the cooling device itself and an airflow amount of the cooling fan disposed adjacent to the cooling device. For example, when the cooling device of the deep freezing compartment is the thermoelectric module, the controller may perform the refrigerating compartment (or freezing compartment) cooling operation with priority when the refrigerating compartment (or freezing compartment) cooling operation and the deep freezing compartment cooling operation conflict with each other. Here, a voltage lower than a maximum voltage that is capable of being applied to the thermoelectric module may be input into the thermoelectric module.

Third, when the conflict between special operations occurs, the priority of the operations may be determined as follows.

I. When a refrigerating compartment door load correspondence operation conflicts with a freezing compartment door load correspondence operation, the controller may control the refrigerating compartment door load correspondence operation to be performed with priority.

II. When the freezing compartment door load correspondence operation conflicts with the deep freezing compartment door load correspondence operation, the controller may control the deep freezing compartment door load correspondence operation to be performed with priority.

III. If the refrigerating compartment operation and the deep freezing compartment door load correspondence operation conflict with each other, the controller may control the refrigerating compartment operation and the deep freezing compartment door load correspondence operation so as to be performed at the same time. Then, when the temperature of the refrigerating compartment reaches a specific temperature a, the controller may control the deep freezing compartment door load correspondence operation so as to be performed exclusively. When the refrigerating compartment temperature rises again to reach a specific temperature b ($a<b$) while the deep freezing compartment door load correspondence operation is performed independently, the controller may control the refrigerating compartment operation and the deep freezing compartment door load correspondence operation so as to be performed at the same time. Thereafter, an operation switching process between the simultaneous operation of the deep freezing compartment and the refrigerating compartment and the single operation of the deep freezing compartment may be controlled to be repeatedly performed according to the temperature of the refrigerating compartment.

As an extended modified example, when the operation input condition for the deep freezing compartment load correspondence operation is satisfied, the controller may control the operation to be performed in the same manner as when the refrigerating compartment operation and the deep freezing compartment door load correspondence operation conflict with each other.

Hereinafter, as an example, the description is limited to the case in which the first storage compartment is the refrigerating compartment, the second storage compartment is the freezing compartment, and the third storage compartment is the deep freezing compartment.

FIG. 1 is a view illustrating a refrigerant circulation system of a refrigerator according to an embodiment of the present invention.

Referring to FIG. 1, a refrigerant circulation system according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. The above components are connected to each other by a refrigerant pipe to constitute a closed circuit.

In detail, the expansion valve may include a refrigerating compartment expansion valve 14 and a freezing compartment expansion valve 15. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

A switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser to control the flow direction of the refrigerant, or alternatively, the switching valves are mounted at inlet sides of a refrigerating compartment expansion valve 14 and a freezing compartment expansion valve 15, respectively.

As a first example of an evaporator arrangement manner, the evaporator may include a refrigerating compartment evaporator 16 connected to an outlet side of the refrigerating compartment expansion valve 14 and a heat sink and a freezing compartment evaporator 17, which are connected in series to an outlet side of the freezing compartment expansion valve 15. The heat sink 24 and the freezing compartment evaporator 17 are connected in series, and the refrigerant passing through the freezing compartment expansion valve passes through the heat sink 24 and then flows into the freezing compartment evaporator 17.

As a second example, the heat sink 24 may be disposed at an outlet side of the freezing compartment evaporator 17 so that the refrigerant passing through the freezing compartment evaporator 17 flows into the heat sink 24.

As a third example, a structure in which the heat sink 24 and the freezing compartment evaporator 17 are connected in parallel at an outlet end of the freezing compartment expansion valve 15 is not excluded.

Although the heat sink 24 is the evaporator, it is provided for the purpose of cooling a heat generation surface of the thermoelectric module to be described later, not for the purpose of heat-exchange with the cold air of the deep freezing compartment.

In each of the three examples described above with respect to the arrangement manner of the evaporator, a complex system of a first refrigerant circulation system, in which the switching valve 13, the refrigerating compartment expansion valve 14, and the refrigerating compartment evaporator 16 are removed, and a second refrigerant circulation system constituted by the refrigerating compartment cooling evaporator, the refrigerating compartment cooling expansion valve, the refrigerating compartment cooling condenser, and a refrigerating compartment cooling compressor is also possible. Here, the condenser constituting the first refrigerant circulation system and the condenser constituting the second refrigerant circulation system may be independently provided, and a complex condenser which is provided as a single body and in which the refrigerant is not mixed may be provided.

The refrigerant circulation system of the refrigerator having the two storage compartments including the deep freezing compartment may be configured only with the first refrigerant circulation system.

Hereinafter, as an example, the description will be limited to a structure in which the heat sink and the freezing compartment evaporator 17 are connected in series.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafrezing temperature by a thermoelectric module to be described later are formed inside the refrigerator provided with the refrigerant circulation system according to the embodiment of the present invention. The refrigerating compartment and the freezing compartment may be disposed adjacent to each other in a vertical direction or horizontal direction and are partitioned from each other by a partition wall. The deep freezing compartment may be provided at one side of the inside of the freezing compartment, but the present invention includes the deep freezing compartment provided at one side of the outside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric module 21 having one side through which heat is absorbed and the other side through which heat is released when power is supplied, a cold sink 22 mounted on the heat absorption surface of the thermoelectric module 21, a heat sink mounted on the heat generation surface of the thermoelectric module 21, and an insulator 23 that blocks heat exchange between the cold sink 22 and the heat sink.

Here, the heat sink 24 is an evaporator that is in contact with the heat generation surface of the thermoelectric module 21. That is, the heat transferred to the heat generation surface of the thermoelectric module 21 is heat-exchanged with the refrigerant flowing inside the heat sink 24. The refrigerant flowing along the inside of the heat sink 24 and absorbing heat from the heat generation surface of the thermoelectric module 21 is introduced into the freezing compartment evaporator 17.

In addition, a cooling fan may be provided in front of the cold sink 22, and the cooling fan may be defined as the deep freezing compartment fan 25 because the fan is disposed behind the inside of the deep freezing compartment.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric module 21. The heat transferred to the heat absorption surface is transferred to the heat generation surface of the thermoelectric module 21.

The heat sink 24 functions to absorb the heat absorbed from the heat absorption surface of the thermoelectric module 21 and transferred to the heat generation surface of the thermoelectric module 21 again to release the heat to the outside of the thermoelectric module 20.

Figure 2:
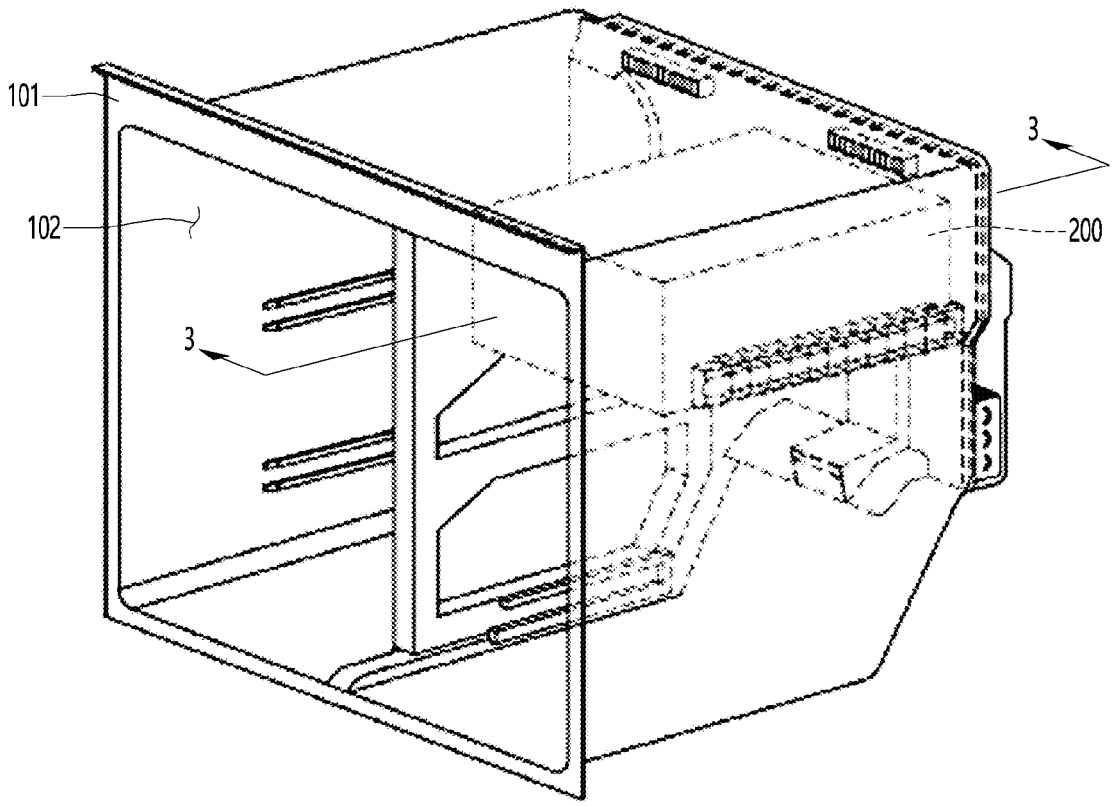
FIG. 2 is a perspective view illustrating structures of a freezing compartment and a deep freezing compartment of the refrigerator according to an embodiment of the present invention.
Figure 3:
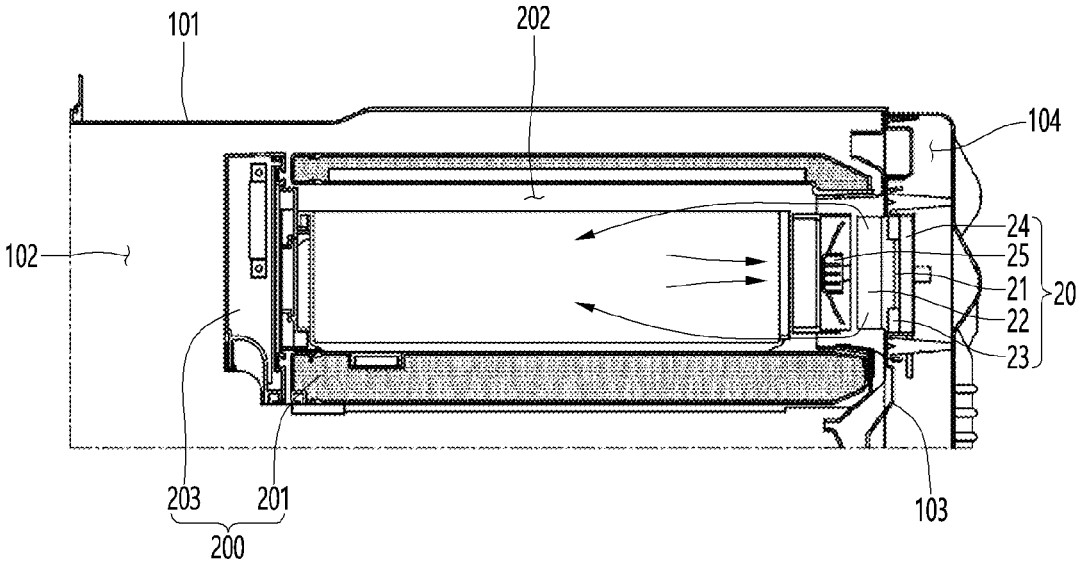
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

Instead of applying the deep freezing compartment drawer 203, a structure in which a deep freezing compartment door is connected to one side of the front side of the deep freezing case 201, and the entire inside of the deep freezing compartment 201 is configured as a food storage space is also possible.

In addition, the rear surface of the inner case 101 is stepped backward to form a freezing evaporation compartment 104 in which the freezing compartment evaporator 17 is accommodated. In addition, an inner space of the inner case 101 is divided into the freezing evaporation compartment 104 and the freezing compartment 102 by the partition wall 103. The thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be an evaporator connected to the freezing compartment expansion valve 15 as described above. A space in which the heat sink 24 is accommodated may be formed in the partition wall 103.

Since the two-phase refrigerant cooled to a temperature of about −18° C. to −20° C. while passing through the freezing compartment expansion valve 15 flows inside the heat sink 24, a surface temperature of the heat sink 24 may be maintained to a temperature of −18° C. to −20° C. Here, it is noted that a temperature and pressure of the refrigerant passing through the freezing compartment expansion valve 15 may vary depending on the freezing compartment temperature condition.

When a rear surface of the thermoelectric module 21 is in contact with a front surface of the heat sink 24, and power is applied to the thermoelectric module 21, the rear surface of the thermoelectric module 21 becomes a heat generation surface.

When the cold sink 22 is in contact with a front surface of the thermoelectric module, and power is applied to the thermoelectric module 21, the front surface of the thermoelectric module 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Here, when a housing surrounding or accommodating at least a portion of a heat conductor constituted by the heat conduction plate and the heat exchange fin is provided, the cold sink 22 has to be interpreted as a heat transfer member including the housing as well as the heat conductor. This is equally applied to the heat sink 22, and the heat sink 22 has be interpreted not only as the heat conductor constituted by the heat conduction plate and the heat exchange fin, but also as the heat transfer member including the housing when a housing is provided.

The deep freezing compartment fan 25 is disposed in front of the cold sink 22 to forcibly circulate air inside the deep freezing compartment 202.

Hereinafter, efficiency and cooling capacity of the thermoelectric module will be described.

The efficiency of the thermoelectric module 20 may be defined as a coefficient of performance (COP), and an efficiency equation is as follows.

$$COP = \frac{Q_c}{P_e}$$

Qc: Cooling Capacity (ability to absorb heat)

Pe: Input Power (power supplied to thermoelectric element)

$$P_e = V \times i$$

In addition, the cooling capacity of the thermoelectric module 20 may be defined as follows.

$$Q_c = \alpha T_c i - \frac{1}{2}\frac{\rho L}{A} i^2 - \frac{kA}{L}(T_h - T_c)$$

<Semiconductor Material Property Coefficient>

α: Seebeck Coefficient [V/K]

ρ: Specific Resistance [Ωm−1]

k: Thermal conductivity [Ωm−1]

<Semiconductor Structure Characteristics>

L: Thickness of thermoelectric module: Distance between heat absorption surface and heat generation surface A: Surface of thermoelectric module <System Use Condition> i: Current

V: Voltage

Th: Temperature of heat generation surface of thermoelectric module

Tc: Temperature of heat absorption surface of thermoelectric module

In the above cooling capacity equation, a first item at the right may be defined as a Peltier Effect and may be defined as an amount of heat transferred between both ends of the heat absorption surface and the heat generation surface by a voltage difference. The Peltier effect increases in proportional to supply current as a function of current.

In the formula V=iR, since a semiconductor constituting the thermoelectric module acts as resistance, and the resistance may be regarded as a constant, it may be said that a voltage and current have a proportional relationship. That is, when the voltage applied to the thermoelectric module 21 increases, the current also increases. Accordingly, the Peltier effect may be seen as a current function or as a voltage function.

The cooling capacity may also be seen as a current function or a voltage function. The Peltier effect acts as a positive effect of increasing in cooling capacity. That is, as the supply voltage increases, the Peltier effect increases to increase in cooling capacity.

The second item in the cooling capacity equation is defined as a Joule Effect.

The Joule effect means an effect in which heat is generated when current is applied to a resistor. In other words, since heat is generated when power is supplied to the thermoelectric module, this acts as a negative effect of reducing the cooling capacity. Therefore, when the voltage supplied to the thermoelectric module increases, the Joule effect increases, resulting in lowering of the cooling capacity of the thermoelectric module.

The third item in the cooling capacity equation is defined as a Fourier effect.

The Fourier effect means an effect in which heat is transferred by heat conduction when a temperature difference occurs on both surfaces of the thermoelectric module.

In detail, the thermoelectric module includes a heat absorption surface and a heat generation surface, each of which is provided as a ceramic substrate, and a semiconductor disposed between the heat absorption surface and the heat generation surface. When a voltage is applied to the thermoelectric module, a temperature difference is generated between the heat absorption surface and the heat generation surface. The heat absorbed through the heat absorption surface passes through the semiconductor and is transferred to the heat generation surface. However, when the temperature difference between the heat absorption surface and the heat absorption surface occurs, a phenomenon in which heat flows backward from the heat generation surface to the heat absorption surface by heat conduction occurs, which is referred to as the Fourier effect.

Like the Joule effect, the Fourier effect acts as a negative effect of lowering the cooling capacity. In other words, when the supply current increases, the temperature difference (Th−Tc) between the heat generation surface and the heat absorption surface of the thermoelectric module, i.e., a value ΔT, increases, resulting in lowering of the cooling capacity.

Figure 4:
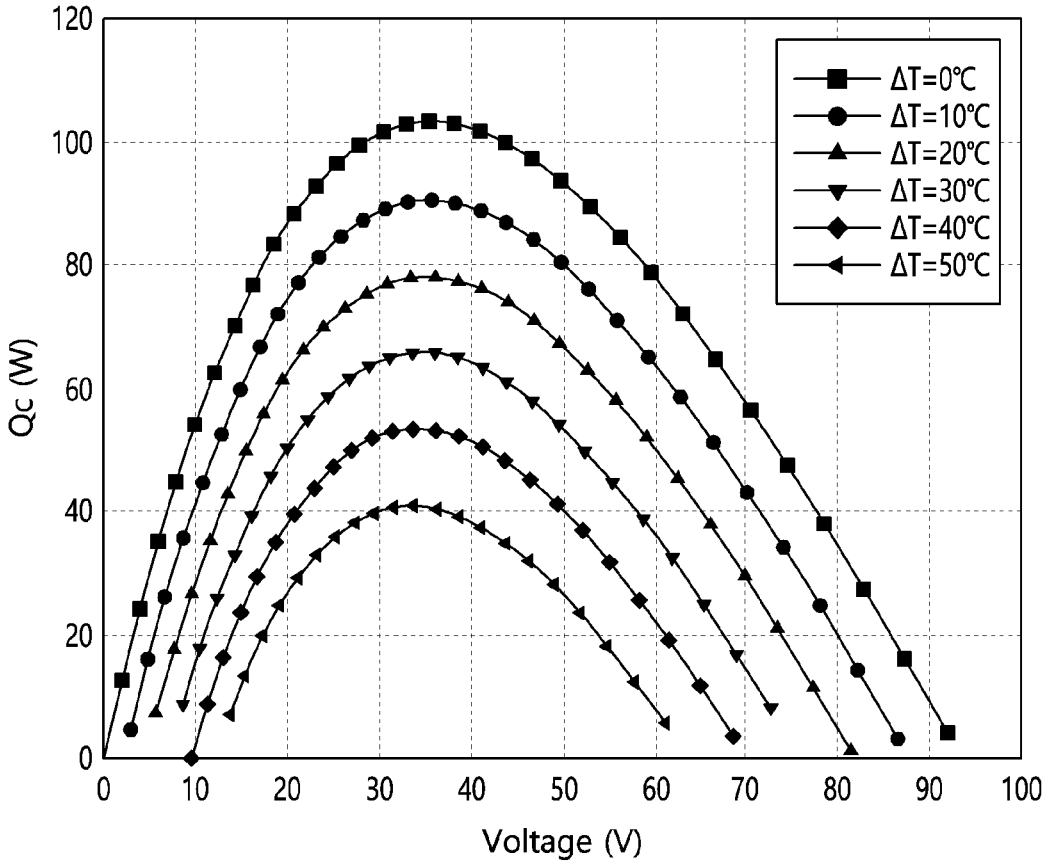
FIG. 4 is a graph illustrating a relationship of cooling capacity with respect to an input voltage and a Fourier effect.

FIG. 4 is a graph illustrating a relationship of cooling capacity with respect to the input voltage and the Fourier effect.

Referring to FIG. 4, the Fourier effect may be defined as a function of the temperature difference between the heat absorption surface and the heat generation surface, that is, a value ΔT.

In detail, when standards of the thermoelectric module are determined, values k, A, and L in the item of the Fourier effect in the above cooling capacity equation become constant values, and thus, the Fourier effect may be seen as a function with the value ΔT as a variable.

Therefore, as the value ΔT increases, the value of the Fourier effect increases, but the Fourier effect acts as a negative effect on the cooling capacity, and thus the cooling capacity decreases.

As shown in the graph of FIG. 4, it is seen that the greater the value ΔT under the constant voltage condition, the less the cooling capacity.

In addition, when the value ΔT is fixed, for example, when ΔT is 30° C., a change in cooling capacity according to a change of the voltage is observed. As the voltage value increases, the cooling capacity increases and has a maximum value at a certain point and then decreases again.

Here, since the voltage and current have a proportional relationship, it should be noted that it is no matter to view the current described in the cooling capacity equation as the voltage and be interpreted in the same manner.

In detail, the cooling capacity increases as the supply voltage (or current) increases, which may be explained by the above cooling capacity equation. First, since the value ΔT is fixed, the value ΔT becomes a constant. Since the ΔT value for each standard of the thermoelectric module is determined, an appropriate standard of the thermoelectric module may be set according to the required value ΔT.

Since the value ΔT is fixed, the Fourier effect may be seen as a constant, and the cooling capacity may be simplified into a function of the Peltier effect, which is seen as a first-order function of the voltage (or current), and the Joule effect, which is seen as a second-order function of the voltage (or current).

As the voltage value gradually increases, an amount of increase in Peltier effect, which is the first-order function of the voltage, is larger than that of increase in Joule effect, which is the second-order function, of voltage, and consequently, the cooling capacity increases. In other words, until the cooling capacity is maximized, the function of the Joule effect is close to a constant, so that the cooling capacity approaches the first-order function of the voltage.

As the voltage further increases, it is seen that a reversal phenomenon, in which a self-heat generation amount due to the Joule effect is greater than a transfer heat amount due to the Peltier effect, occurs, and as a result, the cooling capacity decreases again. This may be more clearly understood from the functional relationship between the Peltier effect, which is the first-order function of the voltage (or current), and the Joule effect, which is the second-order function of the voltage (or current). That is, when the cooling capacity decreases, the cooling capacity is close to the second-order function of the voltage.

In the graph of FIG. 4, it is confirmed that the cooling capacity is maximum when the supply voltage is in a range of about 30 V to about 40 V, more specifically, about 35 V. Therefore, if only the cooling capacity is considered, it is said that it is preferable to generate a voltage difference within a range of 30 V to 40V in the thermoelectric module.

Figure 5:
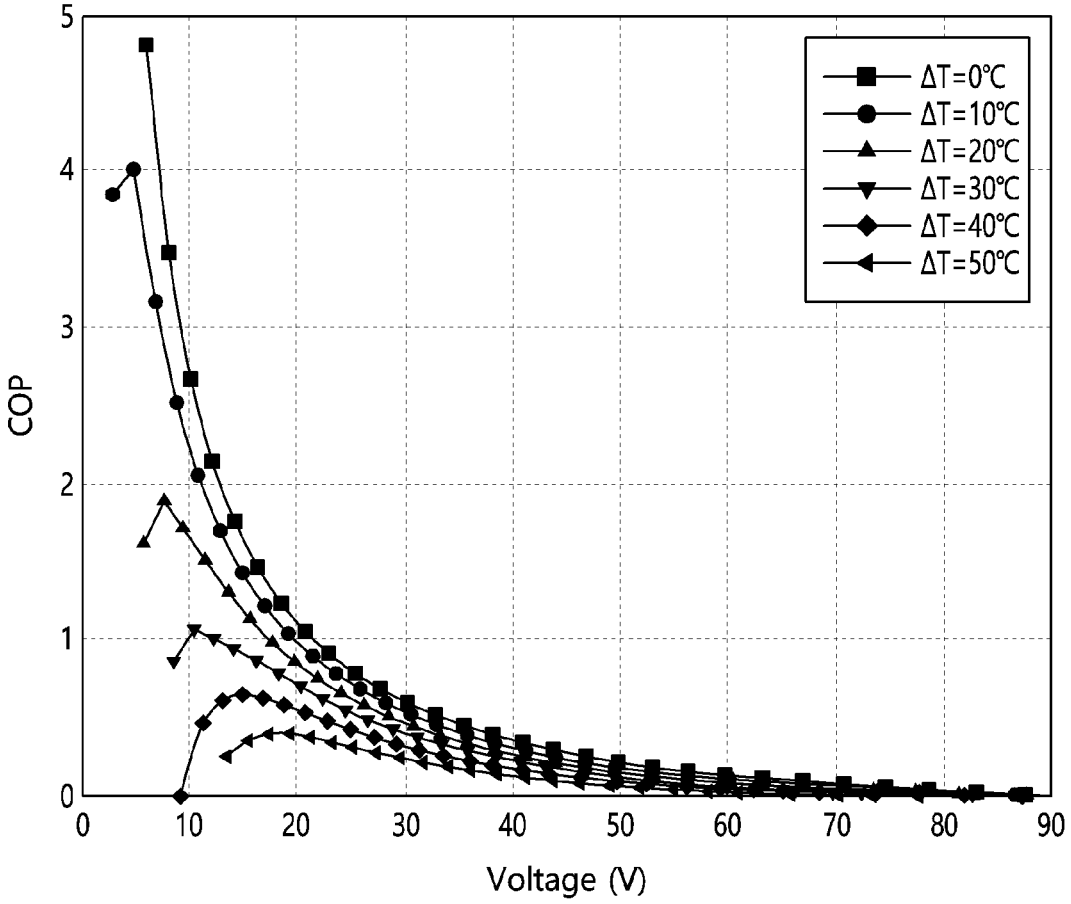
FIG. 5 is a graph illustrating a relationship of efficiency with respect to an input voltage and a Fourier effect.

FIG. 5 is a graph illustrating a relationship of efficiency with respect to the input voltage and the Fourier effect.

Referring to FIG. 5, it is seen that the higher the value ΔT, the lower the efficiency at the same voltage. This will be noted as a natural result because the efficiency is proportional to the cooling capacity.

In addition, when the value ΔT is fixed, for example, when the value ΔT is limited to 30° C. and the change in efficiency according to the change in voltage is observed, the efficiency increases as the supply voltage increases, and the efficiency decreases after a certain time point elapses. This is said to be similar to the graph of the cooling capacity according to the change of the voltage.

Here, the efficiency (COP) is a function of input power as well as cooling capacity, and the input Pe becomes a function of $V^2$ when the resistance of the thermoelectric module 21 is considered as the constant. If the cooling capacity is divided by $V^2$, the efficiency may be expressed as Peltier effect−Peltier effect/$V^2$. Therefore, it is seen that the graph of the efficiency has a shape as illustrated in FIG. 5.

It is seen from the graph of FIG. 5, in which a point at which the efficiency is maximum appears in a region in which the voltage difference (or supply voltage) applied to the thermoelectric module is less than about 20 V. Therefore, when the required value ΔT is determined, it is good to apply an appropriate voltage according to the value to maximize the efficiency. That is, when a temperature of the heat sink and a set temperature of the deep freezing compartment 202 are determined, the value ΔT is determined, and accordingly, an optimal difference of the voltage applied to the thermoelectric module may be determined.

Figure 6:
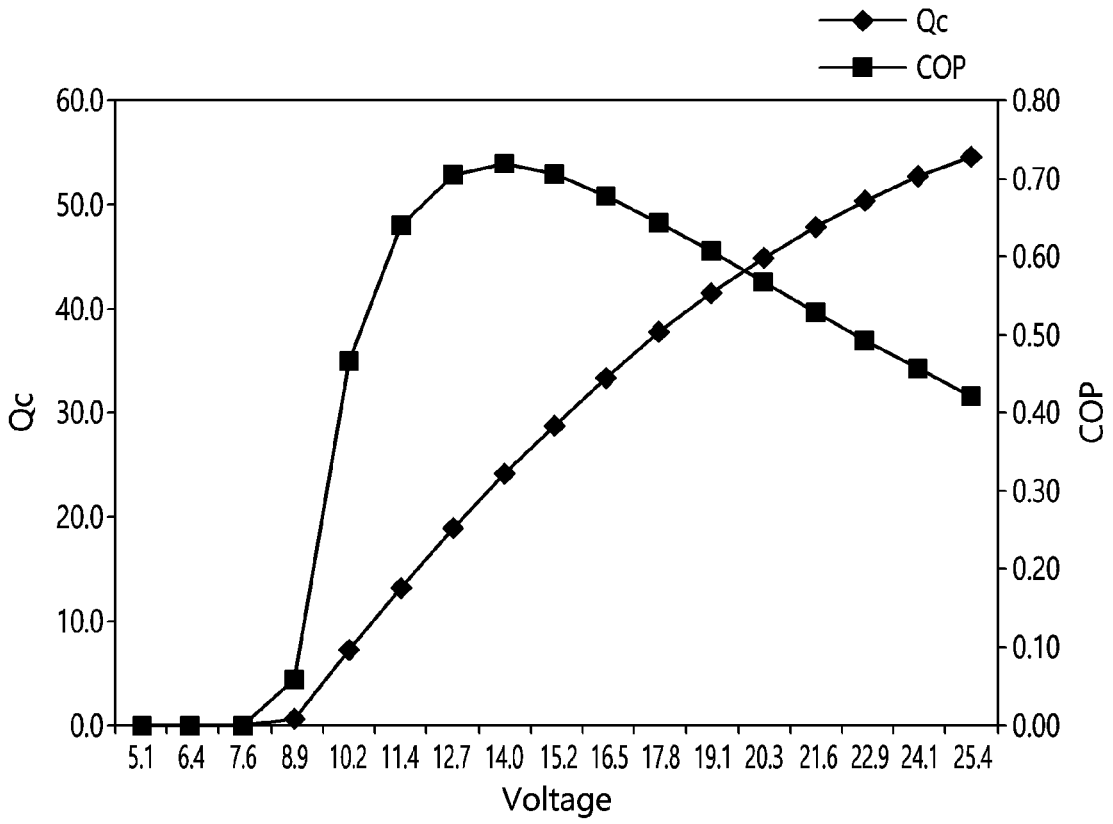
FIG. 6 is a graph illustrating a relationship of cooling capacity and efficiency according to a voltage.

FIG. 6 is a graph illustrating a relationship of the cooling capacity and the efficiency according to a voltage.

Referring to FIG. 6, as described above, as the voltage difference increases, both the cooling capacity and efficiency increase and then decrease.

In detail, it is seen that the voltage value at which the cooling capacity is maximized and the voltage value at which the efficiency is maximized are different from each other. This is seen that the voltage is the first-order function, and the efficiency is the second-order function until the cooling capacity is maximized.

As illustrated in FIG. 6, as an example, in the case of the thermoelectric module having ΔT of 30° C., it is confirmed that the thermoelectric module has the highest efficiency within a range of approximately 12 V to 17 V of the voltage applied to the thermoelectric module. Within the above voltage range, the cooling capacity continues to increase. Therefore, it is seen that a voltage difference of at least 12 V is required in consideration of the cooling capacity, and the efficiency is maximum when the voltage difference is 14 V.

Figure 7:
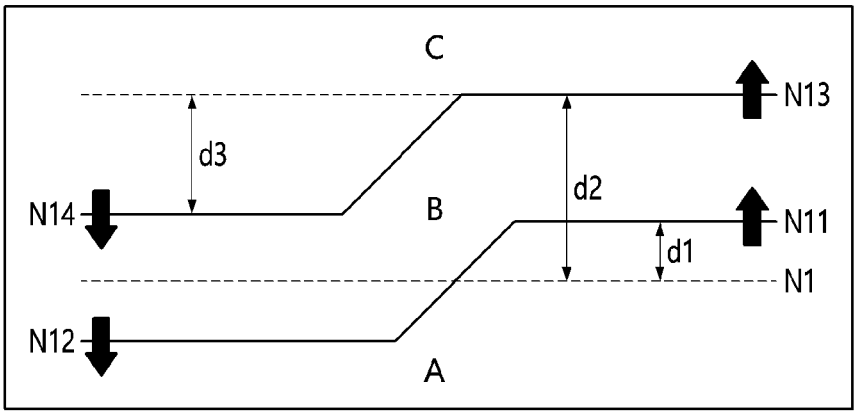
FIG. 7 is a view illustrating a reference temperature line for controlling a refrigerator according to a change in load inside the refrigerator.
Figure 7:
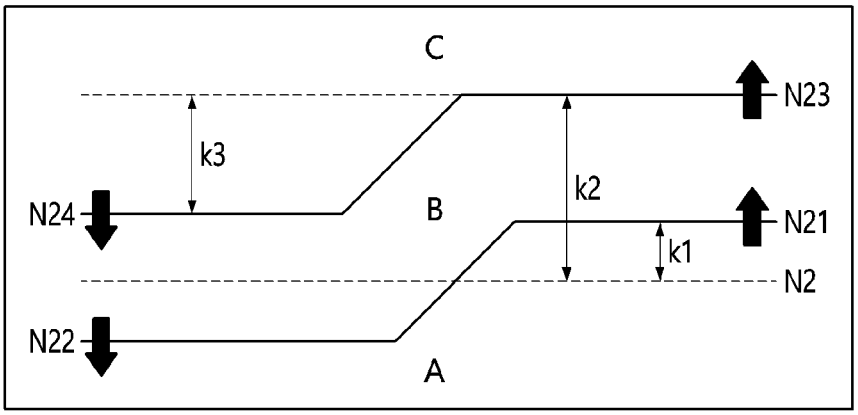
Figure 7:
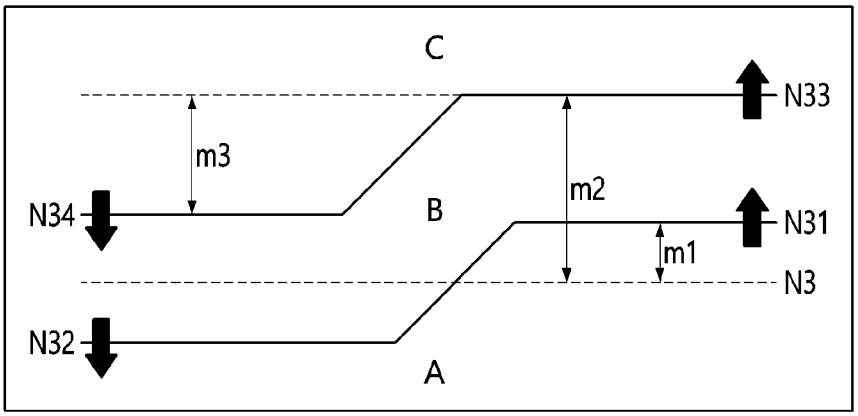

FIG. 7 is a view illustrating a reference temperature line for controlling the refrigerator according to a change in load inside the refrigerator.

Hereinafter, a set temperature of each storage compartment will be described by being defined as a notch temperature. The reference temperature line may be expressed as a critical temperature line.

A lower reference temperature line in the graph is a reference temperature line by which a satisfactory temperature region and a unsatisfactory temperature region are divided. Thus, a region A below the lower reference temperature line may be defined as a satisfactory section or a satisfactory region, and a region B above the lower reference temperature line may be defined as a dissatisfied section or a dissatisfied region.

In addition, an upper reference temperature line is a reference temperature line by which an unsatisfactory temperature region and an upper limit temperature region are divided. Thus, a region C above the upper reference temperature line may be defined as an upper limit region or an upper limit section and may be seen as a special operation region.

When defining the satisfactory/unsatisfactory/upper limit temperature regions for controlling the refrigerator, the lower reference temperature line may be defined as either a case of being included in the satisfactory temperature region or a case of being included in the unsatisfactory temperature region. In addition, the upper reference temperature line may be defined as one of a case of being included in the unsatisfactory temperature region and a case of being included in the upper limit temperature region.

When the internal temperature of the refrigerator is within the satisfactory region A, the compressor is not driven, and when the internal temperature of the refrigerator is in the unsatisfactory region B, the compressor is driven so that the internal temperature of the refrigerator is within the satisfactory region.

In addition, when the internal temperature of the refrigerator is in the upper limit region C, it is considered that food having a high temperature is put into the refrigerator, or the door of the storage compartment is opened to rapidly increase in load within the refrigerator. Thus, a special operation algorithm including a load correspondence operation is performed.

(a) of FIG. 7 is a view illustrating a reference temperature line for controlling the refrigerator according to a change in temperature of the refrigerating compartment.

A notch temperature N1 of the refrigerating compartment is set to a temperature above zero. In order to allow the temperature of the refrigerating compartment to be maintained to the notch temperature N1, when the temperature of the refrigerating compartment rises to a first satisfactory critical temperature N11 higher than the notch temperature N1 by a first temperature difference d1, the compressor is controlled to be driven, and after the compressor is driven, the compressor is controlled to be stopped when the temperature is lowered to a second satisfactory critical temperature N12 lower than the notch temperature N1 by the first temperature difference d1.

The first temperature difference d1 is a temperature value that increases or decreases from the notch temperature N1 of the refrigerating compartment, and the temperature of the refrigerating compartment may be defined as a control differential or a control differential temperature, which defines a temperature section in which the temperature of the refrigerating compartment is considered as being maintained to the notch temperature N1, i.e., approximately 1.5° C.

In addition, when it is determined that the refrigerating compartment temperature rises from the notch temperature N1 to a first unsatisfactory critical temperature N13 which is higher by the second temperature difference d2, the special operation algorithm is controlled to be executed. The second temperature difference d2 may be 4.5° C. The first unsatisfactory critical temperature may be defined as an upper limit input temperature.

After the special driving algorithm is executed, if the internal temperature of the refrigerator is lowered to a second unsatisfactory temperature N14 lower than the first unsatisfactory critical temperature by a third temperature difference d3, the operation of the special driving algorithm is ended. The second unsatisfactory temperature N14 may be lower than the first unsatisfactory temperature N13, and the third temperature difference d3 may be 3.0° C. The second unsatisfactory critical temperature N14 may be defined as an upper limit release temperature.

After the special operation algorithm is completed, the cooling capacity of the compressor is adjusted so that the internal temperature of the refrigerator reaches the second satisfactory critical temperature N12, and then the operation of the compressor is stopped.

(b) of FIG. 7 is a view illustrating a reference temperature line for controlling the refrigerator according to a change in temperature of the freezing compartment.

A reference temperature line for controlling the temperature of the freezing compartment have the same temperature as the reference temperature line for controlling the temperature of the refrigerating compartment, but the notch temperature N2 and temperature variations k1, k2, and k3 increasing or decreasing from the notch temperature N2 are only different from the notch temperature N1 and temperature variations d1, d2, and d3.

The freezing compartment notch temperature N2 may be −18° C. as described above, but is not limited thereto. The control differential temperature k1 defining a temperature section in which the freezing compartment temperature is considered to be maintained to the notch temperature N2 that is the set temperature may be 2° C.

Thus, when the freezing compartment temperature increases to the first satisfactory critical temperature N21, which increases by the first temperature difference k1 from the notch temperature N2, the compressor is driven, and when the freezing compartment temperature is the unsatisfactory critical temperature (upper limit input temperature) N23, which increases by the second temperature difference k2 than the notch temperature N2, the special operation algorithm is performed.

In addition, when the freezing compartment temperature is lowered to the second satisfactory critical temperature N22 lower than the notch temperature N2 by the first temperature difference k1 after the compressor is driven, the driving of the compressor is stopped.

After the special operation algorithm is performed, if the freezing compartment temperature is lowered to the second unsatisfactory critical temperature (upper limit release temperature) N24 lower by the third temperature difference k3 than the first unsatisfactory temperature N23, the special operation algorithm is ended. The temperature of the freezing compartment is lowered to the second satisfactory critical temperature N22 through the control of the compressor cooling capacity.

Even in the state that the deep freezing compartment mode is turned off, it is necessary to intermittently control the temperature of the deep freezing compartment with a certain period to prevent the deep freezing compartment temperature from excessively increasing. Thus, the temperature control of the deep freezing compartment in a state in which the deep freezing compartment mode is turned off follows the temperature reference line for controlling the temperature of the freezing compartment disclosed in (b) FIG. 7.

As described above, the reason why the reference temperature line for controlling the temperature of the freezing compartment is applied in the state in which the deep freezing compartment mode is turned off is because the deep freezing compartment is disposed inside the freezing compartment.

That is, even when the deep freezing compartment mode is turned off, and the deep freezing compartment is not used, the internal temperature of the deep freezing compartment has to be maintained at least at the same level as the freezing compartment temperature to prevent the load of the freezing compartment from increasing.

Therefore, in the state that the deep freezing compartment mode is turned off, the deep freezing compartment notch temperature is set equal to the freezing compartment notch temperature N2, and thus the first and second satisfactory critical temperatures and the first and second unsatisfactory critical temperatures are also set equal to the critical temperatures N21, N22, N23, and N24 for controlling the freezing compartment temperature.

(c) of FIG. 7 is a view illustrating a reference temperature line for controlling the refrigerator according to a change in temperature of the deep freezing compartment in a state in which the deep freezing compartment mode is turned on.

In the state in which the deep freezing compartment mode is turned on, that is, in the state in which the deep freezing compartment is on, the deep freezing compartment notch temperature N3 is set to a temperature significantly lower than the freezing compartment notch temperature N2, i.e., is in a range of about −45° C. to about −55° C., preferably −55° C. In this case, it is said that the deep freezing compartment notch temperature N3 corresponds to a heat absorption surface temperature of the thermoelectric module 21, and the freezing compartment notch temperature N2 corresponds to a heat generation surface temperature of the thermoelectric module 21.

Since the refrigerant passing through the freezing compartment expansion valve 15 passes through the heat sink 24, the temperature of the heat generation surface of the thermoelectric module 21 that is in contact with the heat sink 24 is maintained to a temperature corresponding to the temperature of the refrigerant passing through at least the freezing compartment expansion valve. Therefore, a temperature difference between the heat absorption surface and the heat generation surface of the thermoelectric module, that is, $\Delta T$ is 32° C.

The control differential temperature m1, that is, the deep freezing compartment control differential temperature that defines a temperature section considered to be maintained to the notch temperature N3, which is the set temperature, is set higher than the freezing compartment control differential temperature k1, for example, 3° C.

Therefore, it is said that the set temperature maintenance consideration section defined as a section between the first satisfactory critical temperature N31 and the second satisfactory critical temperature N32 of the deep freezing compartment is wider than the set temperature maintenance consideration section of the freezing compartment.

In addition, when the deep freezing compartment temperature rises to the first unsatisfactory critical temperature N33, which is higher than the notch temperature N3 by the second temperature difference m2, the special operation algorithm is performed, and after the special operation algorithm is performed, when the deep freezing compartment temperature is lowered to the second unsatisfactory critical temperature N34 lower than the first unsatisfactory critical temperature N33 by the third temperature difference m3, the special operation algorithm is ended. The second temperature difference m2 may be 5° C.

Here, the second temperature difference m2 of the deep freezing compartment is set higher than the second temperature difference k2 of the freezing compartment. In other words, an interval between the first unsatisfactory critical temperature N33 and the deep freezing compartment notch temperature N3 for controlling the deep freezing compartment temperature is set larger than that between the first unsatisfactory critical temperature N23 and the freezing compartment notch temperature N2 for controlling the freezing compartment temperature.

This is because the internal space of the deep freezing compartment is narrower than that of the freezing compartment, and the thermal insulation performance of the deep freezing case 201 is excellent, and thus, a small amount of the load input into the deep freezing compartment is discharged to the outside. In addition, since the temperature of the deep freezing compartment is significantly lower than the temperature of the freezing compartment, when a heat load such as food is penetrated into the inside of the deep freezing compartment, reaction sensitivity to the heat load is very high.

For this reason, when the second temperature difference m2 of the deep freezing compartment is set to be the same as the second temperature difference k2 of the freezing compartment, frequency of performance of the special operation algorithm such as a load correspondence operation may be excessively high. Therefore, in order to reduce power consumption by lowering the frequency of performance of the special operation algorithm, it is preferable to set the second temperature difference m2 of the deep freezing compartment to be larger than the second temperature difference k2 of the freezing compartment.

A method for controlling the refrigerator according to an embodiment of the present invention will be described below.

Hereinafter, the content that a specific process is performed when at least one of a plurality of conditions is satisfied should be construed to include the meaning that any one, some, or all of a plurality of conditions have to be satisfied to perform a particular process in addition to the meaning of performing the specific process if any one of the plurality of conditions is satisfied at a time point of determination by the controller.

Figure 8:
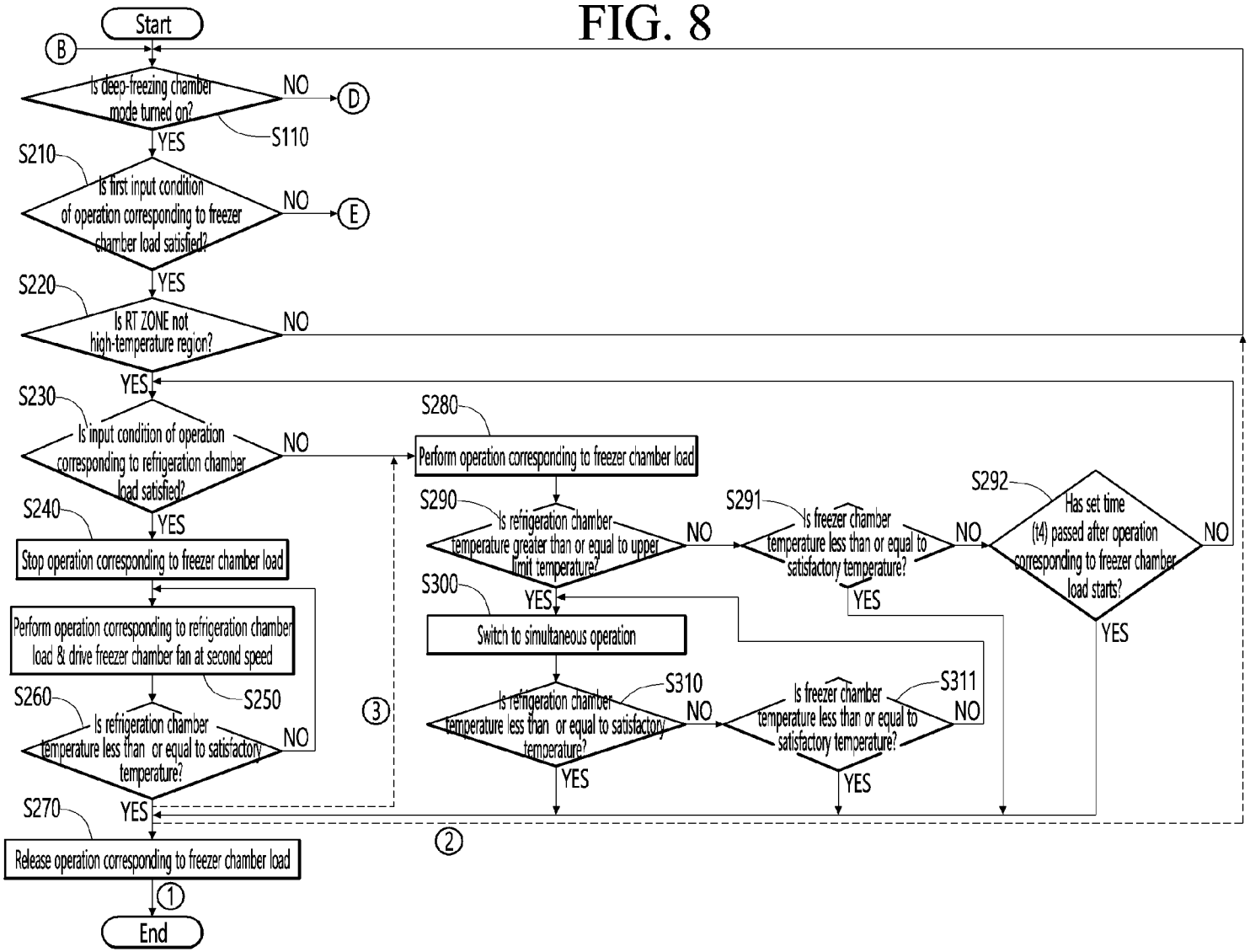
FIGS. 8 and 9 are flowcharts illustrating a method for controlling a freezing compartment load correspondence operation according to an embodiment of the present invention.
Figure 9:
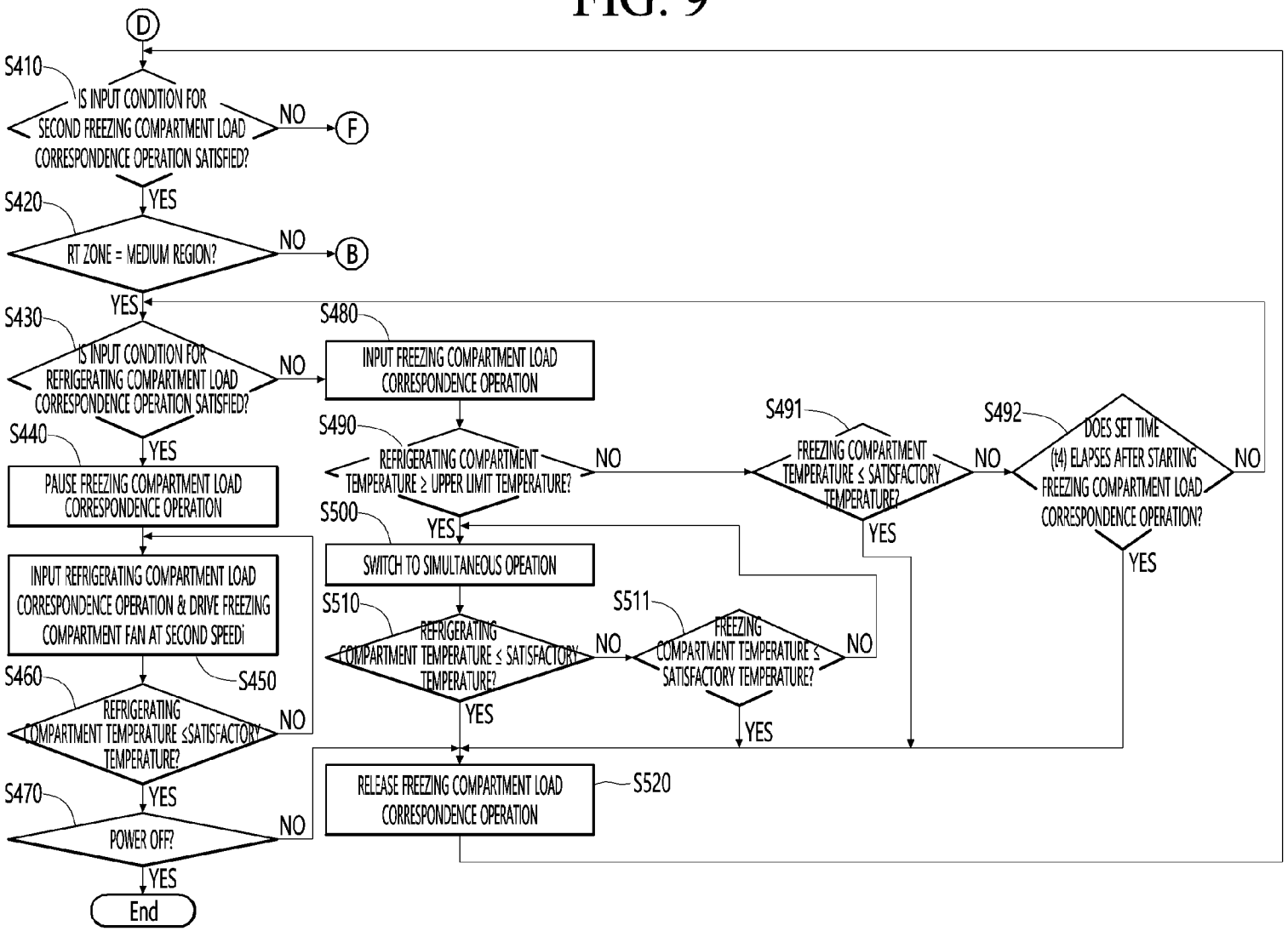

FIGS. 8 and 9 are flowcharts illustrating a method for controlling the freezing compartment load correspondence operation according to an embodiment of the present invention.

In detail, the flowchart disclosed in FIG. 8 illustrates a method for controlling the freezing compartment load correspondence operation when the deep freezing compartment mode is in on state, and the flowchart disclosed in FIG. 9 illustrates a method for controlling the freezing compartment load correspondence operation when the deep freezing compartment mode is in an off state.

When the deep freezing compartment mode is turned on, a user presses a deep freezing compartment mode execution button to indicate that the deep freezing compartment mode is in a state capable of being performed. Thus, in the state in which the deep freezing compartment mode is turned on, power may be immediately applied to the thermoelectric module when the specific condition is satisfied.

Conversely, a state in which the deep freezing compartment mode is turned off means a state in which power supply to the thermoelectric module is cut off. Thus, power is not supplied to the thermoelectric module and the deep freezing compartment fan except for exceptional cases.

First, referring to FIG. 8, the controller determines whether the current state is the deep freezing compartment mode on state (S110). If it is determined that the current deep freezing compartment mode is in the off state, the process proceeds to a process D, which will be described in detail with reference to FIG. 9.

In detail, when it is determined that the deep freezing compartment mode is in the on state at present, the controller determines whether the current state is in a state that satisfies an "input condition for a first freezing compartment load correspondence operation" (S210).

The "input condition for the first freezing compartment load correspondence operation" refers to a load correspondence operation condition for rapidly removing a load of the freezing compartment by inputting a load into the freezing compartment in a state in which the deep freezing compartment mode is the on state.

For example, the "input condition for the first freezing compartment load correspondence operation may include a case in which the freezing compartment temperature rises by a set temperature Ta within a set time ta from a time point at which the freezing compartment door is closed. The set time ta may be 210 seconds, but is not limited thereto, and the set temperature Ta may be 2° C., but is not limited thereto.

When the "input condition for the first freezing compartment load-correspondence operation" is satisfied, it is determined whether a room temperature zone (RT zone) to which the current room temperature belongs corresponds to a region other than a high temperature region (S220). That is, it is determined whether the room temperature zone (RT zone) to which the current room temperature belongs to a medium temperature region or a low temperature region.

In detail, the controller may store a lookup table divided into a plurality of room temperature zones (RT zones) according to a range of the room temperature. As an example, as shown in Table 1 below, it may be subdivided into eight room temperature zones (RT zones) according to the range of the room temperature. However, the present invention is not limited thereto.

TABLE 1

| High temperature region | | Medium temperature region | | | Low temperature region | | |
|---|---|---|---|---|---|---|---|
| RT Zone 1 | RT Zone 2 | RT Zone 3 | RT Zone 4 | RT Zone 5 | RT Zone 6 | RT Zone 7 | RT Zone 8 |
| T ≥ 38° C. | 34° C. ≤ T < 38° C. | 27° C. ≤ T < 34° C. | 22° C. ≤ T < 27° C. | 18 ≤ T < 22° C. | 12° C. ≤ T < 18° C. | 8° C. ≤ T < 12° C. | T < 8° C. |

In more detail, a zone of the temperature range with the highest room temperature may be defined as an RT zone 1 (or Z1), and a zone of the temperature range with the lowest room temperature may be defined as an RT zone 8 (or Z8). Here, Z1 may be mainly seen as the indoor state in midsummer, and Z8 may be seen as an indoor state in the middle of winter.

Furthermore, the room temperature zones may be grouped into a large category, a medium category, and a small category. For example, as shown in Table 1, the room temperature zone may be defined as a low temperature zone, a medium temperature zone (or a comfortable zone), and a high temperature zone according to the temperature range.

If it is determined that the zone (RT zone) to which the current room temperature belongs does not correspond to the low temperature region and the medium temperature region, but correspond to the high temperature region, the freezing compartment load correspondence operation may not be performed, and the operation may return to an initial operation S110.

The reason for excluding the case in which the current room temperature is in the high temperature region is that an operating rate of the freezing compartment fan is relatively high, and thus, possibility of generation of frost on the outer wall of the deep freezing compartment is low. However, the freezing compartment load correspondence operation according to the present invention may not be limited in room temperature. That is, omission of operation S220 is not excluded.

On the other hand, if it is determined that the deep freezing compartment mode is in the on state at present, but the current state does not satisfy the "input condition for the first freezing compartment load correspondence operation", the process proceeds to a process E to perform "a control of an output of the freezing compartment fan in the state in which the deep freezing compartment mode is turned on", and this will be described in detail with reference to FIG. 10.

When it is determined that the "the input condition for the first freezing compartment load correspondence operation" is satisfied, and the room temperature is also a temperature in the medium temperature region or the low temperature region, the controller determines whether the "input condition for the refrigerating compartment load correspondence operation" is satisfied (S230).

The "the input condition for the refrigerating compartment load correspondence operation" may be appropriately set in consideration of various conditions including an operation condition and an installation space condition in the refrigerating compartment, similarly to the "condition for the freezing compartment load correspondence operation".

As an example, the "input condition for the refrigeration compartment load correspondence operation" may include a case in which the refrigerating compartment temperature rises by more than a set temperature Tb from the refrigerating compartment temperature immediately before opening the refrigerator door within a set time tb after closing the refrigerating compartment door. Here, the set time tb may be 5 minutes, but is not limited thereto, and the set temperature Tb may be 2° C., but is not limited thereto.

When the "input condition for the refrigeration compartment load correspondence operation" is satisfied, conflict between the load correspondence operations occurs as a situation in which a situation for the refrigerating compartment load correspondence operation and a situation for the freezing compartment load correspondence operation occur at the same time.

When the refrigerating compartment load correspondence operation and the freezing compartment load correspondence operation conflict with each other, the controller prioritizes the refrigerating compartment load correspondence operation. This is based on a method for controlling a load refrigerator in which a storage compartment having a high satisfactory temperature in the refrigerator is first cooled, and then a storage compartment having a low satisfactory temperature in the refrigerator is cooled. If the storage compartment having the lower satisfactory temperature is first cooled, the temperature of the storage compartment having the high satisfactory temperature rapidly increases to increase in possibility of spoilage of the stored food.

Based on this reason, when the freezing compartment load correspondence operation and the refrigerating compartment load correspondence operation conflict with each other at the same time or with a time difference, the freezing compartment load correspondence operation is controlled to be paused (S240). The pausing of the freezing compartment load correspondence operation means that the freezing compartment valve is closed to prevent the refrigerant from flowing to the freezing compartment evaporator. Here, the pausing of the freezing compartment load correspondence operation includes maintenance of the paused state.

In other words, in the refrigerant circulation system illustrated in FIG. 1, a degree of opening of the switching valve 13 is adjusted so that the refrigerant flows only to the refrigerating compartment expansion valve 14. Here, an operation in which the opening degree of the switching valve 13 is adjusted to prevent the refrigerant from flowing to the freezing compartment expansion valve 15 may be defined as "closing of the freezing compartment valve". Conversely, an operation in which the opening degree of the switching valve 13 is adjusted to prevent the refrigerant from flowing to the refrigerating compartment expansion valve 15 may be defined as "closing of the refrigerator compartment valve".

In a state in which the freezing compartment load correspondence operation is paused, the refrigerator compartment load correspondence operation is input, and the freezing compartment fan is controlled to be driven at a second speed (S250).

When the refrigerating compartment load correspondence operation starts, the refrigerating compartment valve is opened, and the refrigerating compartment fan is controlled to rotate at a high speed. When the refrigerating compartment temperature enters the satisfactory temperature range illustrated in (a) of FIG. 7, or a maximum operation time elapses, the refrigerating compartment load correspondence operation may be controlled to be ended. The maximum operation time may be one hour, but is not limited thereto.

In detail, when the freezing compartment load correspondence operation is paused, conventionally, the freezing compartment valve is closed, and the operation of the freezing compartment fan is controlled to be also paused. However, according to the present invention, the refrigerator compartment load correspondence operation is performed, and the freezing compartment fan rotates at a second speed even when the freezing compartment valve is closed.

Then, moisture generated in the freezing compartment by the load input into the freezing compartment while the cold air in the freezing compartment circulates may be discharged into the freezing evaporation compartment. Since the cold air in the freezing compartment circulates, it also has the effect of reducing the possibility of the moisture attached to the outer wall of the deep freezing compartment.

The second speed may be a low speed, but is not limited thereto.

While the refrigerating compartment load correspondence operation is performed, the controller continuously determines whether the refrigerating compartment temperature enters the satisfactory temperature region A illustrated in (a) of FIG. 7 (S260).

When it is determined that the refrigerator compartment temperature enters the satisfactory temperature region A, any one of the following three control methods is performed.

As the first method (①), when the refrigerating compartment temperature enters the satisfactory temperature region (A), the refrigerating compartment load correspondence operation is ended, the refrigerating compartment valve is closed, and the operation of the refrigerating compartment fan is paused, and also, the freezing compartment fan rotating at the second speed is paused.

In addition, the freezing compartment load correspondence operation is released (S270), an algorithm for the freezing compartment load correspondence operation according to the present embodiment is ended. Then, the paused or suspended freezing compartment load correspondence operation is no longer performed and then return to a normal operation state before the load correspondence operation.

As the second method (②), when the refrigerating compartment temperature enters the satisfactory temperature region (A), the refrigerating compartment load correspondence operation is ended, and an algorithm according to this embodiment returns to the initial process to redetermine whether the input condition for the first freezing compartment load correspondence operation is satisfied. In this case, even when the refrigerating compartment load correspondence operation is ended, it is redetermined whether the "input condition for the first freezing compartment load-responding operation" is satisfied while the freezing compartment fan is maintained at the second speed. That is, after the refrigerating compartment load correspondence operation is end, the control may be controlled to return to any one of operations S110 and S210.

As the third method (③), when the refrigerating compartment temperature enters the satisfactory temperature range, the refrigerating compartment load correspondence operation is ended. Without the redetermination process performed in the first method and the second method, the freezing compartment load correspondence operation temporarily paused in operation S240 may be immediately continued. That is, the speed of the freezing compartment fan may vary from the low speed to the medium speed.

On the other hand, when the "input condition for the refrigeration chamber load correspondence operation" is not satisfied (S230), only the freezing compartment load correspondence operation is input exclusively (S280).

In detail, the freezing compartment load correspondence operation may be defined as an operation in which the freezing compartment valve is opened, the refrigerant flows to the freezing compartment evaporator 15, and the freezing compartment fan 171 rotates at the first speed. The first speed may be a medium speed, but is not limited thereto.

For reference, it is preferable that a minimum voltage be supplied to the thermoelectric element during the freezing compartment load correspondence operation. Then, the refrigerant passing through the freezing compartment expansion valve 14 is minimized in heat-exchange with the heat generation surface of the thermoelectric element and increases in heat-exchange with the cold air of the freezing compartment, thereby minimizing a time required for cooling the freezing compartment.

In addition, the thermoelectric element may be driven to prevent a heat load of the freezing evaporation compartment from being penetrated into the deep freezing compartment using the thermoelectric module as a heat transfer medium.

During the freezing compartment load correspondence operation, the controller continuously determines whether the refrigerating compartment temperature rises to an upper limit temperature (S290). Here, when the refrigerating compartment temperature rises to the upper limit temperature, it does not mean that the refrigerating compartment door is opened, and the load penetration occurs, but a case that the internal temperature of the refrigerator naturally rises above the upper limit input temperature.

If it is determined that the refrigerating compartment temperature enters the upper limit region C illustrated in (b) of FIG. 7 during the freezing compartment load correspondence operation (rising above the upper limit input temperature), the operation is switched to a simultaneous operation of cooling the refrigerating compartment and the freezing compartment at the same time (S300).

During simultaneous operation, both the refrigerator compartment fan and the freezing compartment fan may be controlled to rotate at a first speed, but are not limited thereto. During simultaneous operation, it may be controlled so that the freezing compartment load correspondence operation is not performed even if the condition for the freezing compartment load correspondence operation is satisfied.

In addition, when the refrigerating compartment temperature enters a satisfactory temperature region A illustrated in (a) of FIG. 7 (S310), and when the freezing compartment temperature enters a satisfactory temperature region A illustrated in (b) of FIG. 7, if at least one condition is satisfied, the freezing compartment load correspondence operation may be released (S270). That is, even when the temperatures of the refrigerating compartment and the freezing compartment simultaneously enter the satisfactory temperature range, the freezing compartment load correspondence operation may be controlled to be released.

Here, the release of the freezing compartment load correspondence operation may be interpreted as closing the freezing compartment valve and stopping the freezing compartment fan, which means that a simultaneous operation mode is ended.

In addition, even if only the refrigerating compartment temperature enters the satisfactory temperature range, there is no problem even if the freezing compartment load correspondence operation is released for the following reasons. In detail, when the freezing compartment temperature load correspondence operation is released to return to the first process, a determination process (S210) of whether the input condition for the first freezing compartment load correspondence operation is satisfied will be performed. Here, if the condition for the freezing compartment load correspondence operation is not satisfied, the process proceeds to process E, and a process of controlling an output a normal freezing compartment fan is performed. Therefore, even when only the temperature of the refrigerating compartment is satisfied, the freezing compartment load correspondence operation may be released.

In operation S290, if the refrigerating compartment temperature is within the satisfactory temperature range or the unsatisfactory temperature range, a process of determining whether an inner freezing temperature enters the satisfactory temperature range is performed while the freezing compartment load correspondence operation is continued (S291).

In detail, if it is determined that the freezing compartment temperature enters the satisfactory temperature range illustrated in (b) of FIG. 7, naturally, the process proceeds to operation S270 of releasing the freezing compartment load correspondence operation.

However, when the freezing compartment temperature does not reach the satisfactory temperature range, it is determined whether the freezing compartment load correspondence operation elapses a set time t4 (S292). If it is determined that the set time t4 elapses, the freezing compartment load correspondence operation is released even if the freezing compartment temperature does not enter the satisfactory temperature region A (S270).

If the set time t4 does not elapse after the start of the freezing compartment load correspondence operation, the controller determines whether the input condition for the refrigerating compartment load correspondence operation is satisfied even while the freezing compartment load correspondence operation is performed (S230). That is, it is determined whether a situation in which the load input operations conflicts with a time difference occurs, rather than a situation in which the load input operation conflicts at the same time.

Here, it is not assumed that the freezing compartment load correspondence operation occurs while the refrigerating compartment load correspondence operation is first performed, because the situation for the refrigerator operation is not changed even when the situation for the freezing compartment load correspondence operation occurs. That is, when the refrigerating compartment load correspondence operation starts first, the previous operation state is continuously maintained even when the situation for the freezing compartment load correspondence operation occurs.

As described above, when the deep freezing compartment mode is in the on state, since the deep freezing compartment temperature is significantly lower than the freezing compartment temperature, even when the zone (RT zone) to which the room temperature belongs is in the low temperature region, there is high probability that frost is generated on the outer wall of the deep freezing compartment. Thus, the control method according to an embodiment of the present invention is characterized in that an input range of the freezing compartment load correspondence operation is extended to the room temperature zone (RT Zone) having the low temperature region when the deep freezing compartment mode is turned on.

On the other hand, if it is determined in operation S110 of FIG. 8 that the deep freezing compartment mode is in the off state, the control process of FIG. 9 is performed.

Referring to FIG. 9, when the deep freezing compartment mode is turned off, the controller determines whether the "input condition for the second freezing compartment load correspondence operation" is satisfied (S410). In detail, the "input condition for the second freezing compartment load correspondence operation" may be set differently from the "input condition for the first freezing compartment load correspondence operation".

For example, if it is determined that the freezing compartment temperature exceeds a freezing compartment notch temperature N2 or rises to an unsatisfactory temperature range within a set time $t_c$ after closing the freezing compartment door, the input condition for the second freezing compartment load correspondence operation may be defined as being satisfied. The set time $t_c$ may be 3 minutes, but is not limited thereto.

Here, a minimum value of a heat load that satisfies the "the input condition for the first freezing compartment load correspondence operation" may be set to be less than a minimum value of a heat load that satisfies the "the input condition for the second freezing compartment load-correspondence operation". In other words, the heat load that satisfies the input condition for the second freezing compartment load correspondence operation may satisfy the input condition for the first freezing compartment load correspondence operation, but the heat load may not satisfy the input condition for the first freezing compartment load correspondence satisfies the input condition for the second freezing compartment load correspondence.

The reason is that, in the state in which the deep freezing compartment mode is in the on state, the deep freezing compartment temperature is in an extremely low temperature state, and in the state in which the deep freezing compartment mode is in the off state, the deep freezing compartment temperature is the freezing compartment temperature. That is, when the deep freezing compartment mode is in the on state, even if the heat load input into the freezing compartment is relatively small, possibility in which frost occurs on an outer wall of the deep freezing compartment is higher than when the deep freezing compartment mode is in the off state.

Accordingly, under a condition in which an amount of heat load penetrated into the freezing compartment is the same, when the deep freezing compartment mode is in the on state, the freezing compartment load correspondence operation is performed, but when the deep freezing compartment mode is in the off state, the freezing compartment load correspondence operation may not be performed.

Figure 11:
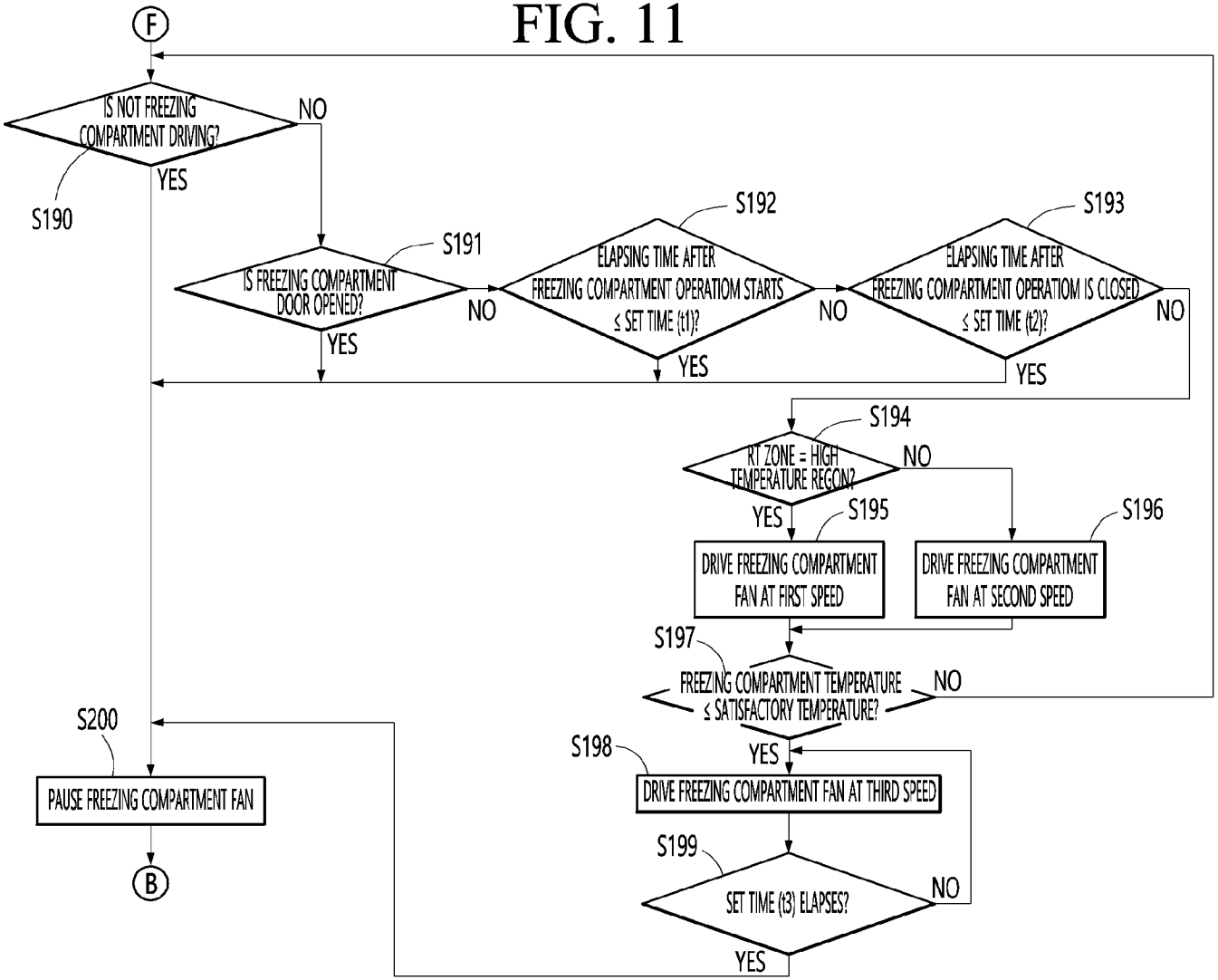
FIG. 11 is a flowchart illustrating a method for controlling the output of the freezing compartment fan when the deep freezing compartment mode is in an off state according to an embodiment of the present invention.

In addition, when the input condition for the second freezing compartment load correspondence operation is not satisfied, the process proceeds to a process F so that the control method illustrated in FIG. 11 is performed, which will be described later. The control method disclosed in FIG. 11 relates to a control of an output of the freezer compartment fan in a state in which the deep freezing compartment is in the off state.

When it is determined that the input condition for the second freezing compartment load correspondence operation is satisfied, a process (S220) of determining whether the current room temperature belongs to the medium temperature region is performed. Here, the fact that the freezing compartment load correspondence operation is performed only when the room temperature belongs to the medium temperature region in a state in which the deep freezing compartment is in the off state is different from the input condition for the freezing compartment load correspondence operation in a state in which the deep freezing compartment mode is in the on state.

If the room temperature does not belong to the medium temperature region, the operation returns to the initial determination process (S110) without executing the freezing compartment load correspondence operation even if the input condition for the freezing compartment load correspondence operation is satisfied. That is, it is controlled so that the freezing compartment load correspondence operation is input only when the room temperature belongs to the medium temperature region.

The reason is that, in the state in which the deep freezing compartment mode is in the off state, the deep freezing compartment temperature and the freezing compartment temperature are controlled to be substantially the same. Thus, in the low temperature region, a normal operation of the freezing compartment may be performed without having to input the freezing compartment load correspondence operation.

On the other hand, if it is determined that the room temperature belongs to the medium temperature region in the state in which the input condition for the second freezing compartment load correspondence operation is satisfied (S410), the controller determines whether the input condition for the refrigerating compartment load correspondence operation is satisfied (S430), when if it is determined that the input condition for the refrigerating compartment load correspondence operation is satisfied, operations S440 to S470 are performed.

Since the contents of operations S440 to S470 are the same as the contents of operations S240 to S270 of FIG. 8, a duplicated description thereof will be omitted.

However, in the case in which the refrigerating compartment load correspondence operation conflicts with the refrigerator compartment load correspondence operation in the state in which the deep freezing compartment is in the off state, and the refrigerator compartment load correspondence operation is performed first, when the refrigerator compartment temperature enters the satisfactory temperature range, the freezing compartment load correspondence operation is controlled to be unconditionally released (S520). However, it should be noted that the second method (performing the determination process) and the third method (continuing the freezing compartment load correspondence operation) described in FIG. 8 are not excluded.

In addition, if it is determined in operation S430 that the conflict of the load correspondence operation does not occur because the input condition for the refrigerating compartment load correspondence operation is not satisfied, the freezing compartment load correspondence operation is performed (S480) The process after the input of the freezing compartment load correspondence operation, that is, the operations S490, S491, S492, S500, S510, S511, and S520 are the same as the contents of operations S290, S291, S292, S300, S310, S311, and S270 described in FIG. 8, and thus, a duplication description thereof will be omitted.

However, after the freezing compartment load correspondence operation is released (S520), the process is controlled to return to the process (S410) of determining whether the input condition for the second freezing compartment load correspondence operation is satisfied, but the process may also be controlled to return to the process of determining whether the deep freezing compartment mode is in the on state (S110). This is because, in the off state of the deep freezing compartment mode, a situation in which the deep freezing compartment mode is selected while the freezing compartment load correspondence operation is performed may occur.

Hereinafter, a method for controlling an output of the freezing compartment fan, which is executed when the situation for the freezing compartment load correspondence operation does not occur in the state in which the deep freezing compartment mode is in the on state will be described.

Figure 10:
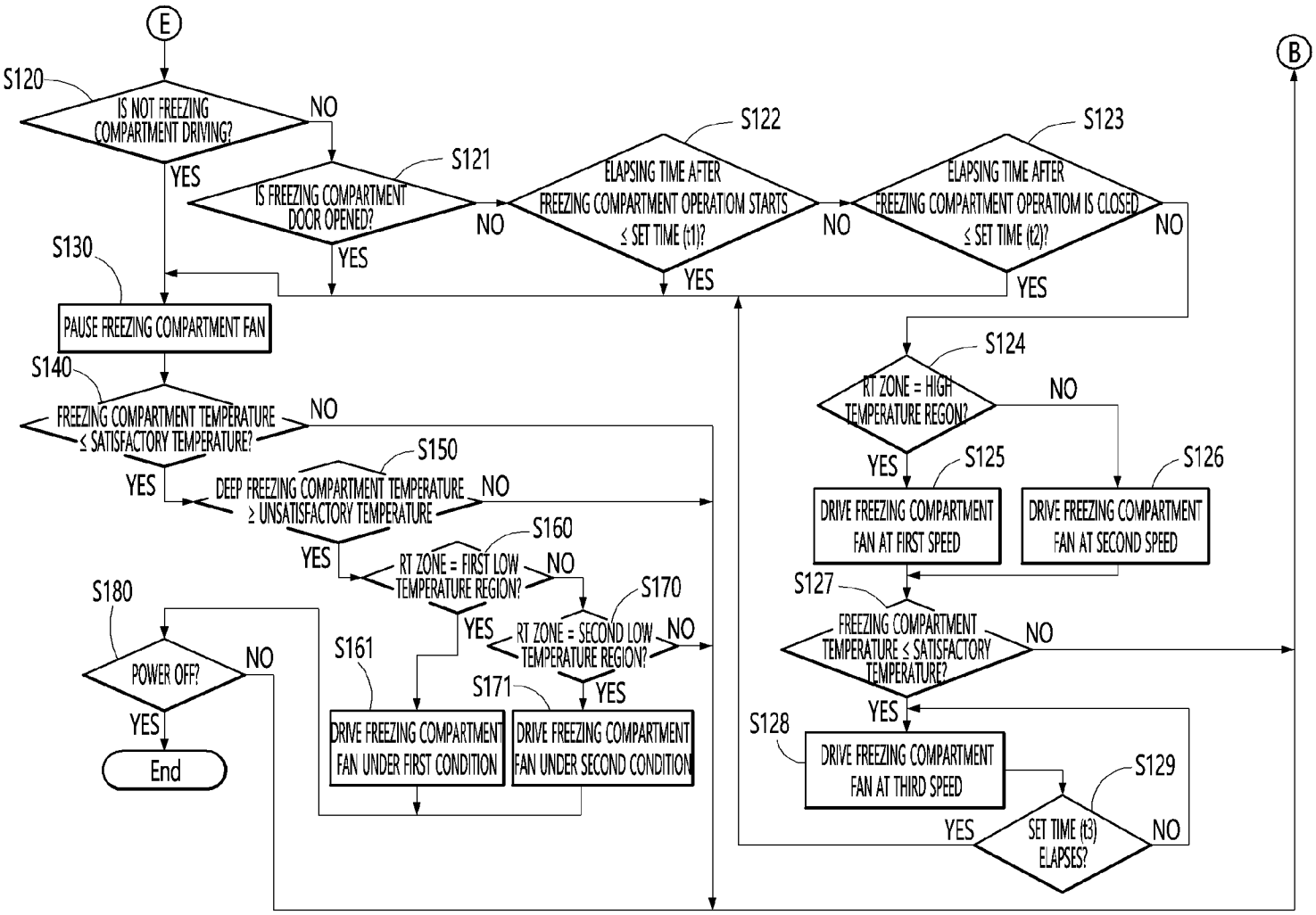
FIG. 10 is a flowchart illustrating a method for controlling an output of a freezing compartment fan when a deep freezing compartment mode is in an on state according to an embodiment of the present invention.

FIG. 10 is a flowchart illustrating a method for controlling the output of the freezing compartment fan when the deep freezing compartment mode is in the on state according to an embodiment of the present invention.

In detail, in the state in which the deep freezing compartment mode is in the on state, the refrigerant flows to the freezing compartment evaporator for cooling the deep freezing compartment even though the freezing compartment is in a satisfactory temperature range, and as a result, the cold air in the freezing evaporation compartment is penetrated into the freezing compartment to lead to sagging of the cold air in the freezing compartment. When the sagging of the cold air occurs, temperature non-uniformity between an upper space and a lower space inside the freezing compartment may occur.

The control method presented in FIG. 10 may be summarized as a control method for preventing such a phenomenon in which the cold air in the freezing compartment is sagged.

Referring to FIG. 10, if it is determined that the current deep freezing compartment mode is in the on state, the controller determines whether the current freezing compartment is in a non-operational state (S120).

The operation of the freezing compartment may not be performed because the freezing compartment is in a satisfactory temperature region A illustrated in (b) of FIG. 7, and even if it is not in the satisfactory temperature region A, the operation of the freezing compartment may not be performed due to other reasons including a refrigerating compartment exclusive operation mode.

Thus, the process (S120) means that it is determined whether the current freezing compartment is in the non-operational state regardless of whether the freezing compartment is in the satisfactory temperature region A.

If the freezing compartment is in the non-operational state, the freezing compartment fan 171 is stopped (S130). Here, the stopping of the freezing compartment fan 171 includes not only stopping of the freezing compartment fan 171 while driving, but also maintaining of the freezing compartment fan 171 that is in the stopped state.

Sequentially, the controller detects the internal temperature of the freezing compartment to determine whether an operation for preventing sagging of cold air in the freezing compartment is performed. That is, the controller determines whether the freezing compartment temperature is in the satisfactory temperature region (S140), and determines whether the cold air sagging prevention operation is performed.

On the other hand, if it is determined that the freezing compartment is currently operating, at least one or more of a process of determining whether the freezing compartment door is opened (S121), a process of determining whether an elapsing time after the freezing compartment process starts is within an actual time $t_1$ (S122), and a process of determining whether an elapsing time after the freezing compartment door is closed is within a set time t2 are performed.

The set time $t_1$ may be 90 seconds, but is not limited thereto, and the set time t2 may be 20 seconds, but is not limited thereto.

Here, when it is determined that the current deep freezing compartment mode is turned on, it is summarized as controlling the refrigerator through the controller to proceed to the state in which the freezing compartment fan is stopped, or the stopping of the freezing compartment fan is maintained when at least one of the determination processes of the processes (S120, S121, S122, and S123) is satisfied (S130). It is natural that it should be interpreted as including a case in which all of the conditions of the processes (S120, S121, S122, and S123) are satisfied.

In the case of performing a plurality of processes among the processes (S121 to S123), the plurality of processes are sequentially performed, but there is no limitation in the order of the execution.

When the conditions determined in the processes (S120, S121, S122, and S123) are not all satisfied, the process proceeds to the process (S124) of determining the room temperature.

In operation S124, the controller determines that the current state is in any zone based on the room temperature at which the refrigerator is installed. For example, it may be determined whether the zone (RT zone) in which the current room temperature belongs is in a high temperature zone. If it is determined that the temperature zone (RT zone) in which the current room temperature belongs is in the high temperature zone, the freezing compartment fan may be driven at a first speed (S125).

If it is determined that the current room temperature zone does not belong to the high temperature zone, the freezing compartment fan may be driven at a second speed (S126). The second speed may be slower than the first speed.

While the freezing compartment fan is driven at the first or second speed, the controller determines whether the freezing compartment temperature enters the satisfactory temperature region A illustrated in (b) of FIG. 7B (S127).

If it is determined that the freezing compartment temperature does not enter the satisfactory temperature region A, the process returns to the process (S110) of determining whether the deep freezing compartment mode is turned on.

On the other hand, if it is determined that the freezing compartment temperature enters the satisfactory temperature region A, the freezing compartment fan is driven at a third speed for a set time t3 (S128 and S129). The third speed may be slower than the second speed. In detail, the first speed may be set to a high speed, the second speed may be set to a medium speed, and the third speed may be set to a low speed.

When the set time t3 elapses, the freezing compartment fan is stopped (S130), and the process proceeds to a process of determining whether to perform the cold air sagging prevention operation (S140 or below). The process (S140) may be a freezing compartment temperature determination process for determining whether the cold air sagging prevention operation is performed in the temperature range in which the freezing compartment temperature is satisfied.

That is, since the freezing compartment temperature is in an unsatisfactory state even when the freezing compartment is not in operation, it is necessary to determine whether the freezing compartment temperature is within the satisfactory temperature range. For example, when it conflicts with another type of operation mode such as an exclusive operation of the refrigerating compartment, the priority of mode execution drops, and thus the operation during the freezing is not performed even though the temperature of the freezing compartment is not in the satisfactory temperature range may not be performed.

On the other hand, if it is determined that the freezing compartment temperature is not within the satisfactory temperature range, the process returns to the process (S110) of determining whether the deep freezing compartment mode is turned on. For example, if it is determined that the freezing compartment temperature does not enter the satisfactory temperature range while the freezing compartment fan rotates at any one speed of the high speed, the medium speed, and the low speed, the process returns to the process (S110) of determining whether the deep freezing compartment mode is turned on to repeatedly determine whether the freezing compartment fan is stopped or continuously rotates.

Here, when it is determined that the freezing compartment temperature does not enter the satisfactory temperature range, it is also possible to control to return to any one of the processes (S120, S121, S122, S123, and S124) in addition to the method of returning to the process (S110).

On the other hand, if it is determined that the current freezing compartment temperature is within the satisfactory temperature range, the first condition for performing the cold air sagging prevention operation may be referred to as a satisfactory state.

If it is determined that the current freezing compartment temperature is within the satisfactory temperature range, a process of determining whether the deep freezing compartment temperature, which corresponds to the second condition, is equal to or greater than the unsatisfactory temperature is performed (S150).

That is, the process of determining whether the deep freezing compartment temperature is above the unsatisfactory temperature, that is, in the regions B and A illustrated in (b) of FIG. 7 is performed. This is seen as a condition that the controlling of the freezing compartment fan for preventing the cold air sagging according to the present invention is performed under the condition that the deep freezing compartment cooling operation is being performed in the unsatisfactory temperature region of the deep freezing compartment.

When it is determined that the deep freezing compartment temperature is above the unsatisfactory temperature, it is determined whether the current room temperature, which corresponds to the third condition, belongs to the low temperature region (S160).

In detail, in this process, it is determined whether the current room temperature is equal to or less than the upper limit temperature of the first low temperature region.

A case in which the current room temperature is lower than the maximum temperature of the first low temperature region, and thus, the room temperature zone (RT zone) to which the current temperature belongs is Z7 or more means that a temperature difference between a temperature within the refrigerator and a temperature of the indoor space is relatively low due to the very low room temperature, and thus, a loss of cold air is not large. As a result, the period for driving the freezing compartment fan is relatively long, and a driving time is controlled to be short.

The long operation period of the freezing compartment fan means that it takes a long time to restart the freezing compartment fan after stopping the operation. Therefore, since the compressor circulates the refrigerant by operating at the maximum cooling capacity for cooling the deep freezing compartment while the freezing compartment fan is stopped, there is a high possibility that cold air inside the freezing evaporation compartment in which the freezing compartment evaporator is accommodated is introduced into the floor of the freezing compartment.

In this situation, the freezing compartment fan is controlled to operate under the first condition (S161).

On the other hand, when it is determined that the room temperature zone (RT zone) to which the current room temperature belongs does not correspond to the first low temperature region, that is, whether the room temperature zone belongs to the second low temperature region higher than the temperature of the first low temperature region is determined.

In detail, when it is determined that the room temperature zone (RZ zone) to which the current room temperature belongs corresponds to the second low temperature region, the freezing compartment fan is controlled to be driven under the second condition (S171).

Here, the second low temperature region may include, but is not limited to, the room temperature zone (RT zone) 6 in the table above and may also include the room temperature zone (RT zone) 5 corresponding to the medium temperature region.

The first condition and the second condition for driving the freezing compartment fan are defined as a ratio of a driving time and a stopping time of the freezing compartment fan. The freezing compartment fan stopping time under the first condition may be set longer than the freezing compartment fan stopping time under the second condition.

For example, in the first condition, a ratio of the stopping time (off time) of the freezing compartment fan to the driving time (on time) of the freezing compartment fan may be 3 or more. More specifically, in the first condition, the freezing compartment fan may be controlled to repeatedly perform an operation of maintaining the stopped state for 225 seconds after being driven for 75 seconds. Here, it should be noted that the ratio of the stopping time to the driving time of the freezing compartment fan is not limited to the conditions presented above.

In addition, in the second condition, a ratio of the freezing time of the freezing compartment fan to the driving time of the freezing compartment fan may be 5 or more. More specifically, in the second condition, the freezing compartment fan may be controlled to repeatedly perform an operation of maintaining the stopped state for 375 seconds after being driven for 75 seconds.

Here, the reason of the design in which the lower the room temperature, the longer the off time of the freezing compartment fan is as follows.

In detail, the lower the room temperature, the more severe the cold air sagging due to the cold air that is reversely penetrated from the freezing evaporation compartment to the freezing compartment. In order to solve this problem, if the on/off ratio of the fan is taken short, it may cause supercooling of the freezing compartment.

In other words, if the off time of the freezing compartment fan is shortened because the cold air sagging phenomenon becomes severe, the freezing compartment supercooling phenomenon may be caused by relatively frequent cold air circulation in the freezing compartment.

Therefore, in order to solve the problem of the sagging of the cold air and simultaneously prevent the supercooling of the freezing compartment, it is better to set the off time of the freezing compartment fan to be longer as the room temperature is lower.

Under the first and second conditions, the freezing compartment fan may be controlled to be constantly maintained at a specific speed, for example, may be controlled to be driven at a low speed, but is not limited thereto.

Under the first and second conditions, the freezing compartment fan may periodically rotate at a low speed (or at another speed) to minimize the phenomenon that cold air in the freezing compartment sags to the bottom of the freezing compartment to causes temperature non-uniformity in the freezing compartment.

In addition, while the freezing compartment fan is repeatedly driven and stopped under any one of the first and second conditions at the set speed, the controller determines whether the refrigerator is powered off (S180), and when the state in which the power is turned on is maintained, the process returns to the process (S110) of determining whether the deep freezing compartment mode is turned on.

Hereinafter, a method for controlling an output of the freezing compartment fan, which is executed when the situation for the freezing compartment load correspondence operation does not occur in the state in which the deep freezing compartment mode is in the off state will be described.

FIG. 11 is a flowchart illustrating a method for controlling the output of the freezing compartment fan when the deep freezing compartment mode is in the off state according to an embodiment of the present invention.

In detail, when the deep freezing compartment mode is turned off, and it is determined that an input condition for a second freezing compartment load correspondence operation is not satisfied, at least one or more processes of a process (S190) of determining whether the freezing compartment is in a non-operational state, a process (S191) of determining whether the freezing compartment door is opened, and a process (S192) of determining whether the elapsing time elapses above the set time $t_1$ after the freezing compartment starts, and a process (S192) of determining whether the elapsing time elapses above the set time t2 after the freezing compartment door is closed will be performed.

If at least one or all of the case in which the freezing compartment is not in operation, the case in which the door of the freezing compartment is opened, and the case in which the elapsing time does not reach the set time $t_1$ after the freezing compartment operation starts, or the case the elapsing time does not reach the set time t2 after the door of the freezing compartment is closed is/are satisfied, the freezing compartment fan is controlled to be stopped (S200). This may be said to be substantially the same as the process of performing the processes (S120 to S123) of FIG. 10.

As described in FIG. 10, the execution order of the processes (S190 to S193) is not limited to the order presented in the flowchart.

On the other hand, if all of the conditions of the processes (S190 to S193) are not satisfied, the process (S194) of detecting the room temperature and determining a zone on which the detected room temperature exists is performed. Here, it is not excluded that all of the processes (S190 to S194) are omitted, and the process proceeds to the process (S194) of directly detecting the room temperature.

When it is determined that the detected room temperature belongs to the high temperature region, the freezing compartment fan may be controlled to be driven at a first speed. If it is determined that the detected room temperature does not belong to the high temperature region, the freezing compartment fan is controlled to drive at a second speed.

In addition, whether the freezing compartment temperature enters the satisfactory temperature region A illustrated in (b) of FIG. 7 is determined, and when it is determined that the freezing compartment temperature does not enter the satisfactory temperature range, the process returns to the process (S190) of determining whether the freezing compartment is not in operation.

Here, when it is determined that the freezing compartment temperature does not enter the satisfactory temperature region A, it is also possible to control to return to any one of the processes (S191, S192, S193, and S194). Alternatively, if the freezing compartment temperature does not reach the satisfactory temperature (S199), it is also possible to control to return to the process (S110) of determining whether the deep freezing compartment mode is turned on.

On the other hand, if it is determined that the freezing compartment temperature enters the satisfactory temperature range, the freezing compartment fan is controlled to be driven at a third speed for a set time t3 (S198 and S199). When the set time t3 elapses, the freezing compartment fan is stopped (S200), and the process returns to the process (S110) of determining whether the deep freezing compartment mode is turned on.

The control method from operations S194 to S200 of FIG. 11 is substantially the same as the control method from operations S124 to S130 of FIG. 10. However, if the deep freezing compartment mode is not turned on, it will be different from the case in which the deep freezing compartment mode is turned on to proceed to the process (S110) of determining whether the deep freezing compartment mode is turned on after the freezing compartment fan is stopped.

That is, when the deep freezing compartment mode is in the on state, it is different from proceeding to the process (S140 or below) of determining whether the cold air sagging operation is performed.

The first to third speeds may be considered the same as the first to third speeds described with reference to FIG. 10.

The invention claimed is:

1. A refrigerator, which comprises:

a refrigerating compartment;

a freezing compartment that is partitioned from the refrigerating compartment;

a deep freezing compartment accommodated in the freezing compartment and partitioned from the freezing compartment;

a thermoelectric module to cool the deep freezing compartment to a temperature less than that of the freezing compartment;

a freezing compartment fan to cause air within the freezing compartment to forcibly flow; and a controller configured to control driving of the freezing compartment fan, wherein, when a heat load is penetrated into the freezing compartment, the controller is configured to perform a freezing compartment load correspondence operation, in which an input condition is different for the freezing compartment load correspondence operation according to whether a deep freezing compartment mode is in an on state or off state, wherein, when the input condition for the freezing compartment load correspondence operation is satisfied, the controller is configured to determine whether a room temperature condition is satisfied, in which the room temperature condition is different according to whether the deep freezing compartment mode is in the on state or off state, wherein the room temperature is a temperature at which the refrigerator is installed.

2. The refrigerator according to claim 1, wherein, when the deep freezing compartment mode is in the on state, the controller is configured to apply an input condition for a first freezing compartment load correspondence operation, when the deep freezing compartment mode is in the off state, the controller is configured to apply an input condition for a second freezing compartment load correspondence operation, and a minimum value of the heat load, which satisfies the input condition for the first freezing compartment load correspondence operation is less than a minimum value of the heat load, which satisfies the input condition for the second freezing compartment load correspondence operation.

3. The refrigerator according to claim 2, wherein, when the deep freezing compartment mode is in the on state, the controller is configured to determine whether a room temperature zone to which a current room temperature belongs corresponds to a first room temperature region, when the deep freezing compartment mode is in the off state, the controller is configured to determine whether the room temperature zone to which the current room temperature belongs corresponds to a second room temperature region, the first room temperature region is set to be wider than the second room temperature region, and a minimum room temperature for the first room temperature region is lower than a minimum room temperature for the second room temperature region.

4. The refrigerator according to claim 3, wherein, when the controller determines that one of the room temperature zone corresponds to the first room temperature region in which the first freezing compartment load correspondence operation is performed, or the room temperature zone corresponds to the second room temperature region in which the second freezing compartment load correspondence operation is performed, the controller is configured to determine whether an input condition for a refrigerating compartment load correspondence operation is satisfied.

5. The refrigerator according to claim 4, wherein, the freezing compartment load correspondence operation is one of the first freezing compartment load correspondence operation or the second freezing compartment load correspondence operation, when the controller determines that the input condition for the refrigerating compartment load correspondence operation is satisfied, the controller is configured to stop the freezing compartment load correspondence operation, and the controller is configured to perform the refrigerating compartment load correspondence operation by priority.

6. The refrigerator according to claim 5, wherein the freezing compartment fan is configured to vary among speed from a first speed to a second speed, the second speed being lower than the first speed, wherein the controller is configured to drive the freezing compartment fan at the second speed during the performance of the refrigerating compartment load correspondence operation.

7. The refrigerator according to claim 6, wherein, when the refrigerating compartment temperature enters a satisfactory temperature region, the controller is configured to end the refrigerating compartment load correspondence operation, stop the driving of the freezing compartment fan, and release the freezing compartment load correspondence operation.

8. The refrigerator according to claim 7, wherein, when the controller releases the freezing compartment load correspondence operation in the state in which the deep freezing compartment mode is in the on state, the controller is configured to determine whether the input condition for the first freezing compartment load correspondence operation is satisfied.

9. The refrigerator according to claim 7, wherein, when the controller releases the freezing compartment load correspondence operation in the state in which the deep freezing compartment mode is in the off state, the controller is configured to determine whether the input condition for the second freezing compartment load correspondence operation is satisfied.

10. The refrigerator according to claim 6, wherein, when the deep freezing compartment mode is in the on state, and the refrigerating compartment temperature enters a satisfactory temperature region, the controller is configured to end the refrigerating compartment load correspondence operation, and while the second speed driving of the freezing compartment fan is maintained, the controller is configured to determine whether the input condition for the first freezing compartment load correspondence operation is satisfied.

11. The refrigerator according to claim 6, wherein, when the deep freezing compartment mode is in the on state, and the refrigerating compartment temperature enters a satisfactory temperature region, the controller is configured to end the refrigerating compartment load correspondence operation, and the controller is configured to pursue the first freezing compartment load correspondence operation.

12. The refrigerator according to claim 4, wherein, the freezing compartment load correspondence operation is one of the first freezing compartment load correspondence operation or the second freezing compartment load correspondence operation, when the controller determines that the input condition for the refrigerating compartment load correspondence operation is not satisfied, the controller is configured to perform the freezing compartment load correspondence operation, and when a set time elapses after a temperature of the freezing compartment enters a satisfactory temperature region, or the refrigerating compartment load correspondence operation starts, the controller is configured to release the freezing compartment load correspondence operation.

13. The refrigerator according to claim 12, wherein, when a temperature at the refrigerating compartment enters an upper limit region while the freezing compartment load correspondence operation is performed, the controller is configured to perform a simultaneous operation mode in which the refrigerating compartment and the freezing compartment are cooled simultaneously.

14. The refrigerator according to claim 13, wherein, when at least one of the temperature at the refrigerating compartment or the temperature at the freezing compartment enters the satisfactory temperature region while the simultaneous operation mode is performed, the controller is configured to release the freezing compartment load correspondence operation.

* * * * *